US006876328B2

(12) United States Patent
Adachi et al.

(10) Patent No.: US 6,876,328 B2
(45) Date of Patent: Apr. 5, 2005

(54) MULTIPLE-RESONANT ANTENNA, ANTENNA MODULE, AND RADIO DEVICE USING THE MULTIPLE-RESONANT ANTENNA

(75) Inventors: Naoki Adachi, Kanagawa (JP); Junji Sato, Tokyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 56 days.

(21) Appl. No.: 10/421,461

(22) Filed: Apr. 23, 2003

(65) Prior Publication Data

US 2004/0004571 A1 Jan. 8, 2004

(30) Foreign Application Priority Data

Apr. 25, 2002 (JP) ..... 2002-123989
Apr. 8, 2003 (JP) ..... 2003-103983

(51) Int. Cl.[7] ..... H01Q 1/38
(52) U.S. Cl. ..... 343/700 MS; 343/846
(58) Field of Search ..... 343/700 MS, 702, 343/725, 728, 846

(56) References Cited

U.S. PATENT DOCUMENTS 4,812,853 A 3/1989 Negev
5,952,917 A * 9/1999 Zimmermann et al. ..... 343/700 MS
6,100,849 A * 8/2000 Tsubaki et al. ..... 343/702
6,323,824 B1 11/2001 Heinrichs et al.
6,448,932 B1 * 9/2002 Stoiljkovic et al. .. 343/700 MS
6,600,449 B2 * 7/2003 Onaka et al. ..... 343/700 MS
2002/0024465 A1 2/2002 Kawahara et al.

FOREIGN PATENT DOCUMENTS

| | | |
|---|---|---|
| EP | 0 398 554 | 11/1990 |
| EP | 0 766 340 | 4/1997 |
| JP | 2001-60823 | 3/2001 |

OTHER PUBLICATIONS

European Search Report corresponding to application No. EP 03 00 8781 dated Oct. 29, 2003.

* cited by examiner

*Primary Examiner*—Hoang V. Nguyen
(74) *Attorney, Agent, or Firm*—RatnerPrestia

(57) ABSTRACT

Disclosed is a multiple-resonant surface-mounted antenna used for a radio device for mobile communication in a microwave band. A high frequency and a low frequency patch antenna electrodes are arranged apart from each other on one main surface of a dielectric block and a feeding line electrode is electromagnetically connected to the respective patch antenna electrodes. Each feeding line electrode is connected to each feeding terminal electrode and connected to each input/output line in every frequency band of a substrate, thereby realizing the multiple-resonant surface-mounted antenna capable of coping with two frequency bands.

33 Claims, 18 Drawing Sheets

MULTIPLE-RESONANT ANTENNA, ANTENNA MODULE, AND RADIO DEVICE USING THE MULTIPLE-RESONANT ANTENNA

FIELD OF THE INVENTION

The present invention relates to a multiple-resonant antenna, antenna module, and a radio device using the multiple-resonant antenna mainly used for a mobile communication radio device in a microwave band.

BACKGROUND OF THE INVENTION

As a mobile communication antenna capable of coping with a plurality of frequency bands, a dielectric patch antenna disclosed in JP-A-2001-60823 is known. In FIG. 1, a dielectric patch antenna 1 is constituted in that a first patch antenna electrode 3 of the length a and a second patch antenna electrode 4 of the length b spaced apart are formed on one surface of the plate-shaped dielectric block 2 that is the base and that a ground electrode 5 that is the ground of the dielectric patch antenna 1 is formed on the bottom surface. By a feeding pin 6 that is an input/output terminal of the dielectric patch antenna 1, the dielectric patch antenna 1 is connected to a first feeding line 9 on a substrate 8 where the dielectric patch antenna 1 is mounted. Further, according to a feeding pin 7 that is a second input/output terminal, it is connected to a second feeding line 10 on the substrate 8.

When such a signal of the frequency band f1 as the length a of the patch antenna electrode 3 can be about half of the propagated wavelength within the dielectric block 2 is entered from the feeding pin 6 into the dielectric patch antenna 1, the patch antenna electrode 3 is oscillated, hence to emit a radio wave. At a receiving time, the patch antenna electrode 3 is oscillated by an incident radio wave of the frequency band f1, hence to supply a receiving signal from the feeding pin 6.

Similarly, when such a signal of the frequency band f2 as the length b of the patch antenna electrode 4 can be about half of the propagated wavelength within the dielectric block 2 is entered from the feeding pin 7 into the dielectric patch antenna 1, the patch antenna electrode 4 is oscillated, hence to emit a radio wave. At a receiving time, the patch antenna electrode 4 is oscillated by an incident radio wave of the frequency band f2, hence to supply a receiving signal from the feeding pin 7.

In the above conventional antenna, since holes are bored in the substrate 8 to feed a signal to the antenna 1 through the feeding pins 6 and 7, the surface mounting on the substrate 8 is difficult.

Since the feeding pin 6 is disposed outside of the antenna electrode 3, the input impedance of the antenna 1 in the frequency f1 becomes high. It is necessary to provide the antenna with a separate match circuit in order to match with, for example, the 50Ω system, and this match circuit deteriorates the efficiency of the antenna 1.

Further, it is necessary to provide it with a feeding port for every frequency band, and a plurality of cables are required in the structure of separating the antenna 1 from a radio unit and in order to connect the both by one cable, a circuit for integration is additionally required.

SUMMARY OF THE INVENTION

In order to solve the above problem, the present invention aims to provide a multiple-resonant antenna capable of coping with a plurality of frequency bands suitable for the surface mounting.

Further, the invention aims to provide a multiple-resonant antenna suitable for the surface mounting and capable of adjusting the input impedance.

Further, the invention aims to provide a multiple-resonant antenna capable of connecting with a radio unit by one cable.

Since the multiple-resonant antenna according to the invention comprises a dielectric block, a plurality of patch antenna electrodes formed on one main surface of the dielectric block, at least a feeding terminal electrode that is an input/output terminal of the antenna, formed on a lateral side of the dielectric block, and at least a feeding line electrode formed on the main surface or the inner layer of the dielectric block so as to be connected to the feeding terminal electrode and then to be electromagnetically connected to the patch antenna electrode, the invention can realize the multiple-resonant antenna corresponding to the surface mounting.

Further, the antenna of the invention comprises a feeding line groove by a hollow on the bottom or the top of the dielectric block so as to accommodate the feeding line electrode, thereby realizing the multiple-resonant antenna corresponding to the surface mounting with the dielectric block of single layer.

Since the invention comprises a first patch antenna electrode formed on one main surface of the dielectric block, for receiving and transmitting a radio wave of a first frequency band f1, a second patch antenna electrode separated from the first patch antenna by some space in a manner of embracing the first patch antenna electrode, for receiving and transmitting a radio wave of a second frequency band f2 (f1>f2), two feeding line electrodes respectively connected to the two patch antenna electrodes electromagnetically, it can realize a dual resonant antenna corresponding to the surface mounting capable of obtaining a good input impedance characteristic in the respective frequency bands.

The invention can realize a dual resonant antenna capable of obtaining a good input impedance in the respective frequency bands by using the manufacturing method of a multi layer substrate, by comprising a dielectric block formed by a multi-layer substrate, including the feeding line electrode as an internal electrode and the feeding terminal electrode by the side metalize.

DESCRIPTION OF THE EXEMPLARY EMBODIMENT

Figure 1:
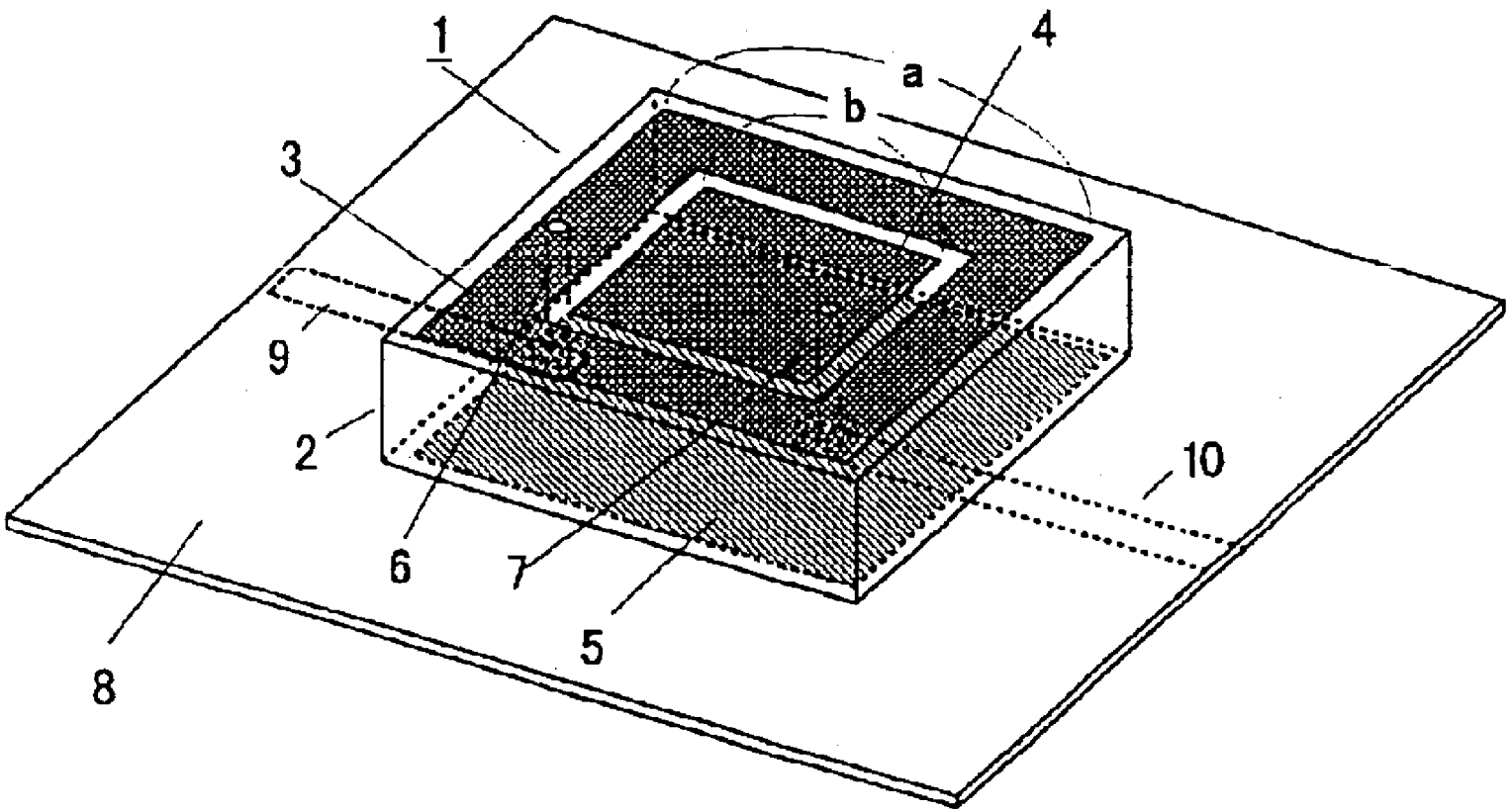
FIG. 1 PRIOR ART
FIG. 1 is a perspective view of the conventional antenna.
Figure 2:
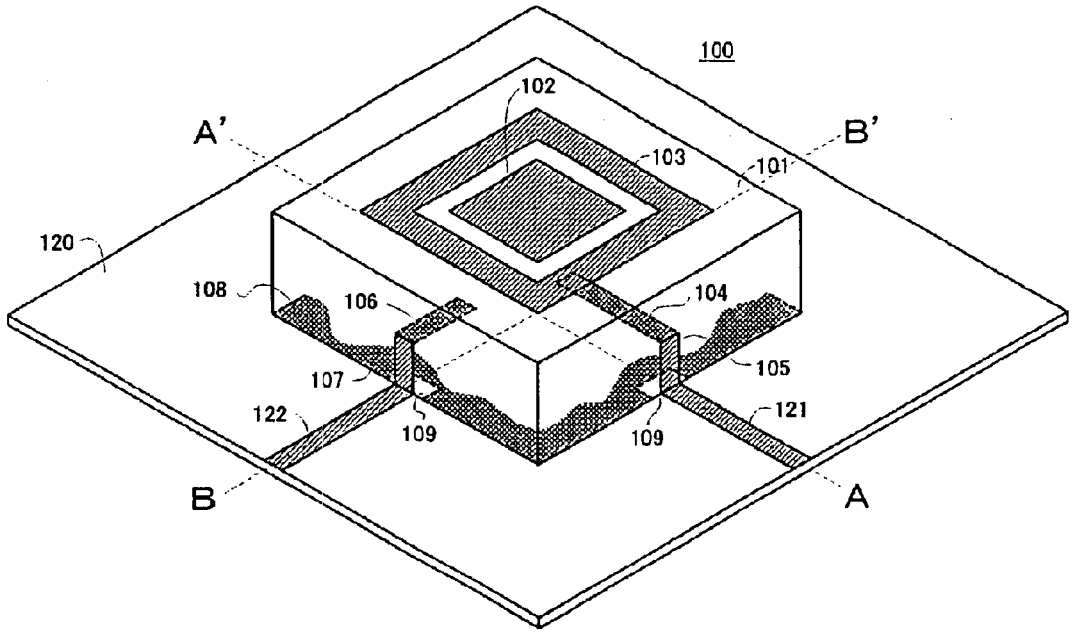
FIG. 2 is a perspective view of an antenna according to a first embodiment of the invention.
Figure 3A:
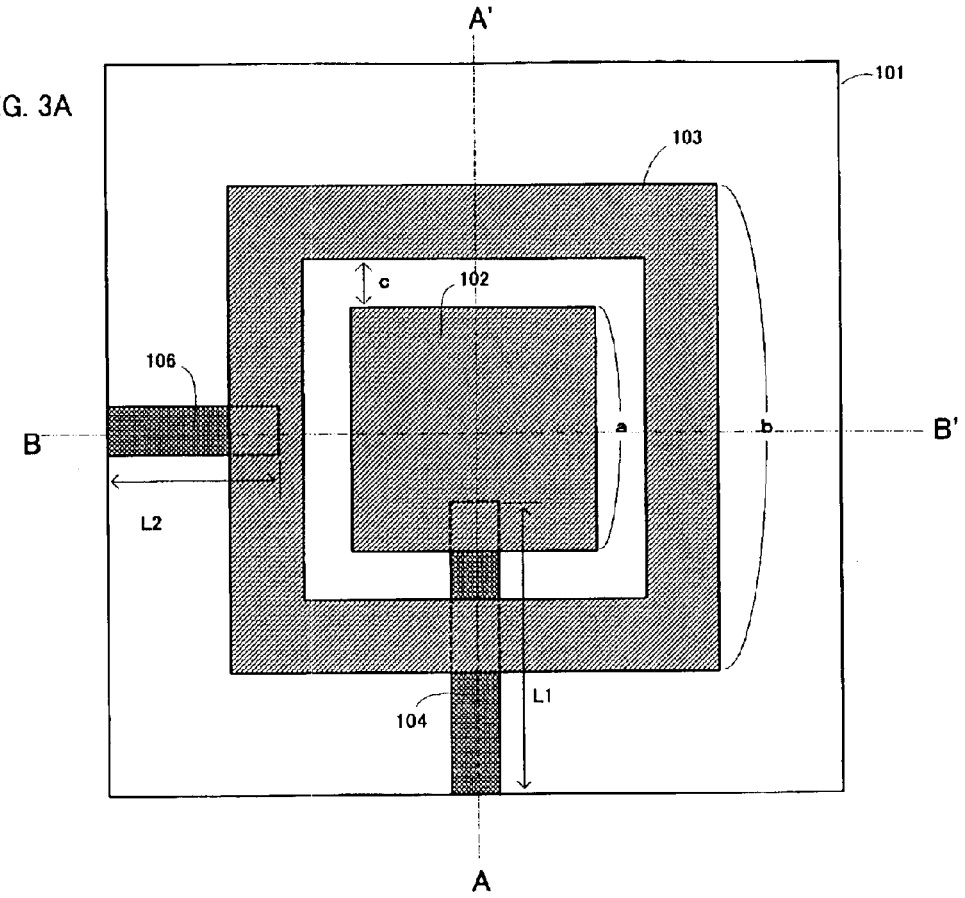
FIG. 3A is a top view of electrode arrangement in the antenna according to the first embodiment of the invention.
Figure 3B:
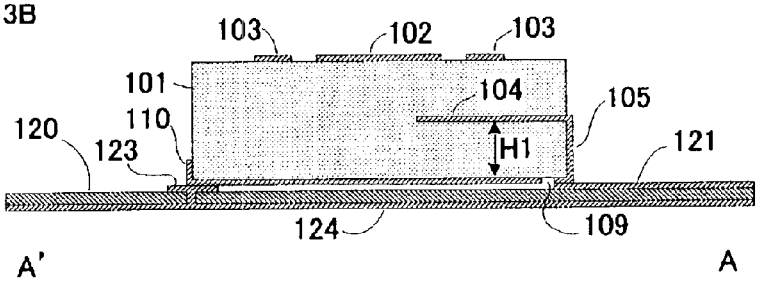
FIG. 3B is an A—A' line-cross sectional view of FIG. 2.
Figure 3C:
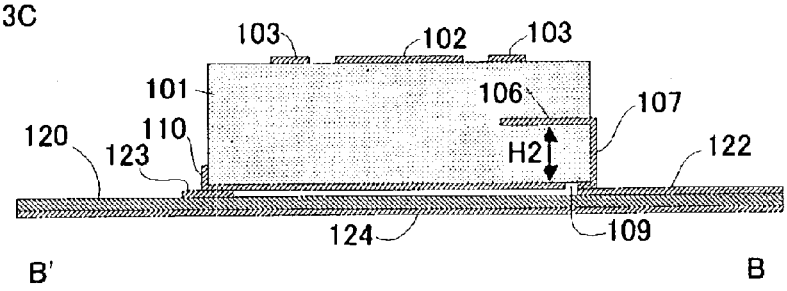
FIG. 3C is a B—B' line-cross sectional view of FIG. 2.

Exemplary embodiments of the present invention are demonstrated hereinafter with reference to the accompanying drawings.

1. First Exemplary Embodiment

In FIG. 2, and FIGS. 3A, 3B, and 3C, an antenna 100 is a dual-band antenna corresponding to the frequency bands f1 and f2 (f1>f2), where a high-frequency patch antenna electrode 102 for the high frequency band f1 of square whose one side is a, is formed on one main surface of a dielectric block 101 having a square plate-shaped horizontal cross section, by the thick film printing. The length a of one side of the high frequency patch antenna electrode 102 is about half of the propagated wavelength in the high frequency band f1 within the dielectric block 101 and it resonates in the high frequency band f1.

A low frequency patch antenna electrode 103 for the low frequency band f2 of square whose one side is b, is formed apart from the high frequency patch antenna electrode 102 by the space of the width c, by the thick film printing, so as to embrace the high frequency patch antenna electrode 102. The length b of one side of the low frequency patch antenna electrode 103 is about half of the propagated wavelength in the low frequency band f2 within the dielectric block 101 and it resonates in the low frequency band f2.

A high frequency feeding line electrode 104 that is a strip line-shaped internal layer electrode whose length is L1 and whose height from the bottom is H1 is electromagnetically connected with the high frequency patch antenna electrode 102, and a high frequency feeding terminal electrode 105 that is an input/output terminal for the high frequency band f1 of the antenna 100 and a fixing terminal at the surface mounting, which is connected to the high frequency feeding line electrode 104, is formed on the lateral side and the bottom side of the dielectric block 101.

A low frequency feeding line electrode 106 that is a strip line-shaped internal layer electrode whose length is L2 and whose height from the bottom is H2 is electromagnetically connected with the low frequency patch antenna electrode 103, and a low frequency feeding terminal electrode 107 that is an input/output terminal for the low frequency band f2 of the antenna 100 and a fixing terminal at the surface mounting, which is connected with the low frequency feeding line electrode 106, is formed on the lateral side and the bottom side of the dielectric block 101.

A ground electrode 108 that is the ground of the antenna 100 is formed on the bottom side of the dielectric block 101, and the feeding terminal electrodes 105 and 107 and the ground electrode 108 are electrically separated by a separating element 109.

A ground terminal electrode 110 that grounds the antenna 100 connected to the ground electrode 108 and that becomes a fixing terminal at the surface mounting is formed on the lateral side of the dielectric block 101.

A high frequency input/output line 121 formed by a micro strip line of 50Ω system is connected with the high frequency feeding terminal electrode 105 in order to receive and supply a signal from and to the antenna 100 in the high frequency band f1 and a low frequency input/output line 122 formed by a micro strip line of 50Ω system is connected with the low frequency feeding terminal electrode 107 in order to receive and supply a signal from and to the antenna 100 in the low frequency band f2. A ground pad 123 is provided in order to connect the ground terminal electrode 110, and it is connected with a ground pad 124 of a substrate 120 by a through hole.

The antenna 100 is surface-mounted on the substrate 120 by connecting the feeding terminal electrode 105 with the end of the input/output line 121, the feeding terminal electrode 107 with the end of the input/output line 122, and the ground terminal electrode 110 with the ground pad 123 respectively by the soldering.

Next, the operation will be described. A transmission signal of the high frequency band f1 is conveyed to the high frequency feeding line electrode 104 after passing through the high frequency input/output line 121 and the high frequency feeding terminal electrode 105, so to oscillate the high frequency patch antenna electrode 102 electromagnetically connected with the high frequency feeding line electrode 104, and the signal is transmitted as a radio wave by the resonance of the high frequency patch antenna electrode 102. At a receiving time, the high frequency patch antenna electrode 102 is resonated and oscillated by the coming radio wave of the high frequency band f1, and the radio wave is transmitted to the high frequency feeding line electrode 104 electromagnetically connected with the high frequency patch antenna electrode 102, passing through the high frequency feeding terminal electrode 105, hence to be supplied to the high frequency input/output line 121.

Similarly, a transmission signal of the low frequency band f2 passes through the low frequency input/output line 122, the low frequency feeding terminal electrode 107, and the low frequency feeding line electrode 106, hence to oscillate the low frequency patch antenna electrode 103 and the signal is transmitted as a radio wave. Further, the low frequency patch antenna electrode 103 is oscillated by the coming radio wave of the low frequency band f2 and supplied to the low frequency input/output line 122 after passing through the low frequency feeding line electrode 106 and the low frequency feeding terminal electrode 107. As mentioned above, the antenna 100 operates as a dual-resonant antenna capable of transmission and reception of the signals of the frequency bands f1 and f2.

Figure 4A:
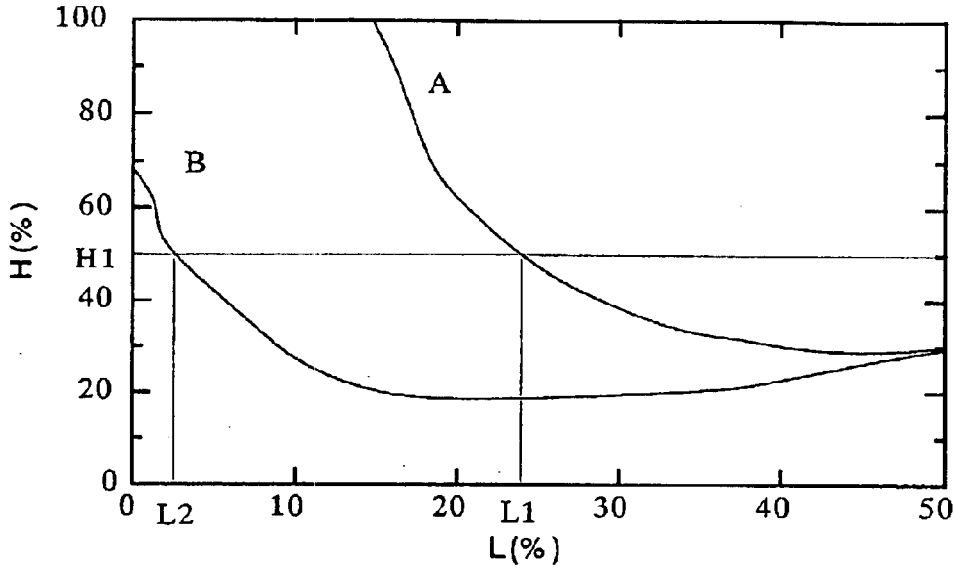
FIGS. 4A and 4B are views showing the characteristic examples of the antenna according to the first embodiment of the invention.

FIG. 4 is an analytic example of an input impedance viewed from the feeding terminal electrode in the case where the dielectric block 101 has a square cross section whose one side is 42 mm, the thickness of 5 mm, the relative permittivity of 7, a=20 mm, b=30 mm, and c=1 mm, where the frequency band f1 uses the band of 2.5 GHz, the frequency band f2 uses the band of 1.5 GHz, and the VSWR uses the value corresponding to the 50Ω system. FIG. 4A is a graph showing the value obtained by normalizing the length of the feeding line electrode by the length b of the low frequency antenna electrode, in the horizontal axis and the value obtained by normalizing the height from the bottom surface of the feeding line by the thickness of the dielectric block, in the vertical axis. A curve A is a trace of the condition of the length L1 and the height H1 in the high frequency feeding line electrode 104, in which the VSWR of the input impedance viewed from the high frequency feeding terminal electrode 105 becomes 1 in the high frequency band f1. A curve B is a trace of the condition of the length L2 and the height H2 in the low frequency feeding line electrode 106, in which the VSWR of the input impedance viewed from the low frequency feeding terminal electrode 107 becomes 1 in the low frequency band f2.

For example, when the height from the bottom surface of the feeding line electrodes 104 and 106, H1=H2, is 50% of the thickness of the dielectric block, the length L1 of the feeding line electrode 104 is about 24% in the trace A and the length L2 of the feeding line electrode 106 is about 3% in the trace B.

Figure 4B:
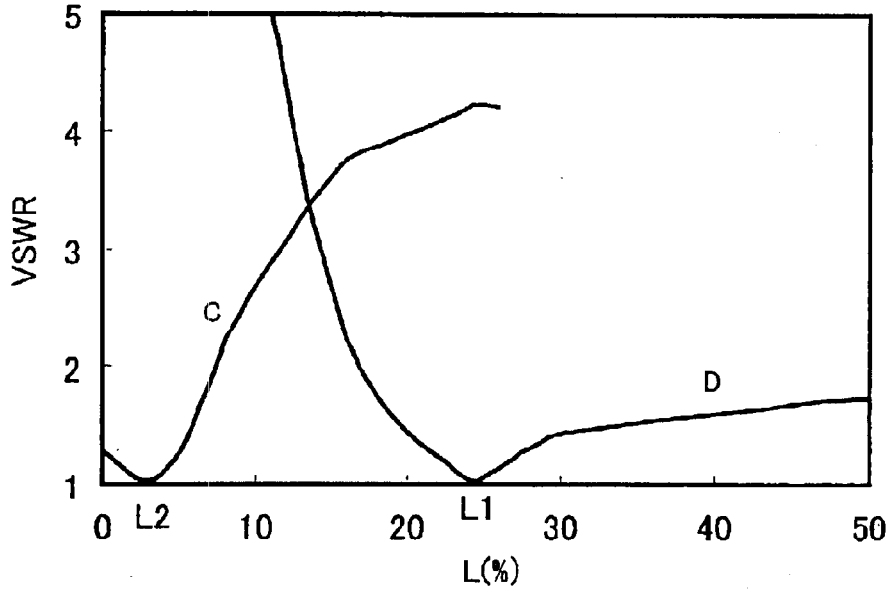

FIG. 4B is an analytic example in the case where the height of the feeding line electrodes, H1=H2, is 50% of the thickness of the dielectric block, with the length of the feeding line electrode shown in the horizontal axis and the VSWR of the input impedance viewed from the feeding terminal electrode shown in the vertical axis. The trace C shows the relationship between the length L1 of the high frequency feeding line electrode 104 and the VSWR in the high frequency band f1, and it shows that a good impedance characteristic can be obtained at the length L1 of 24%. The trace D shows an example of the relationship between the length L2 of the low frequency feeding line electrode 106 and the VSWR characteristic, and it shows that a good impedance characteristic and a better antenna characteristic can be obtained at the length L2 of about 3%.

Figure 5A:
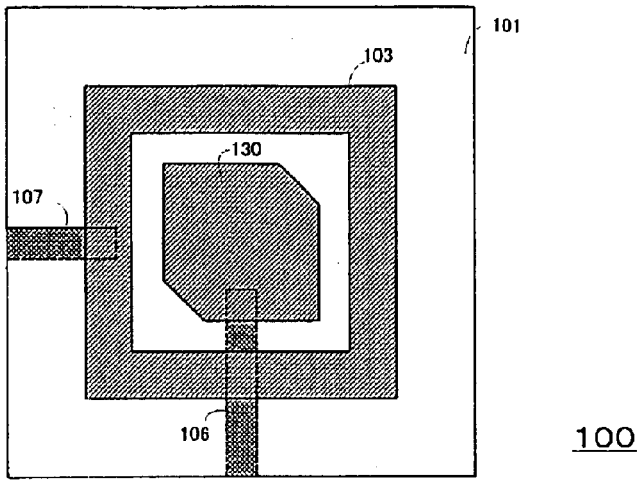
FIGS. 5A, 5B, and 5C are top views of electrode arrangement in another antenna according to the first embodiment of the invention.

FIG. 5 is a top view of electrodes in another antenna of the first embodiment of the invention provided with an antenna electrode for circularly polarized wave. FIG. 5A is an example using a circularly polarized wave patch antenna electrode 130 as the first antenna electrode. Cut-off portions are respectively provided at a pair of opposite angles of a square patch, and a resonant operation counterclockwise viewed from the front side of the antenna is generated by advancing the phase of the resonant operation in the direction of the opposite angles having the cut-off portions, hence to move the antenna as a right hand circularly polarized wave antenna. Therefore, the antenna 100 works as the circularly polarized wave antenna in the frequency band f1 and works as the linear polarized wave antenna in the frequency band f2.

Figure 5B:
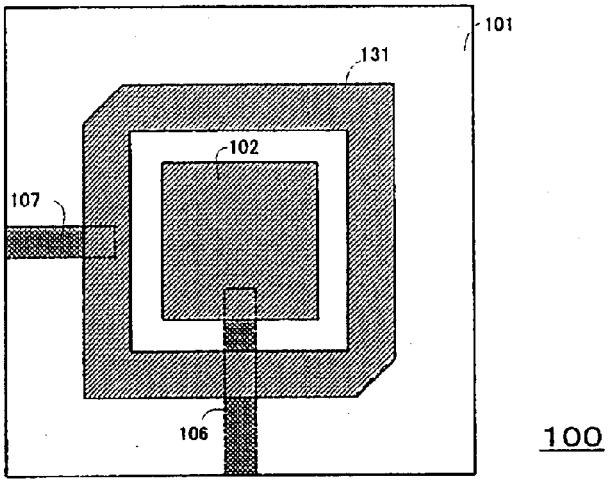

FIG. 5B is an example of using a circularly polarized wave patch antenna 131 as a second antenna electrode, and by providing the cut-off portions in a pair of opposite angles similarly to FIG. 5A, the second antenna electrode operates as the right hand circularly polarized wave antenna, and the antenna 100 becomes a straightly polarized wave antenna in the frequency band f1 and it works as the circularly polarized wave antenna in the frequency f2.

Figure 5C:
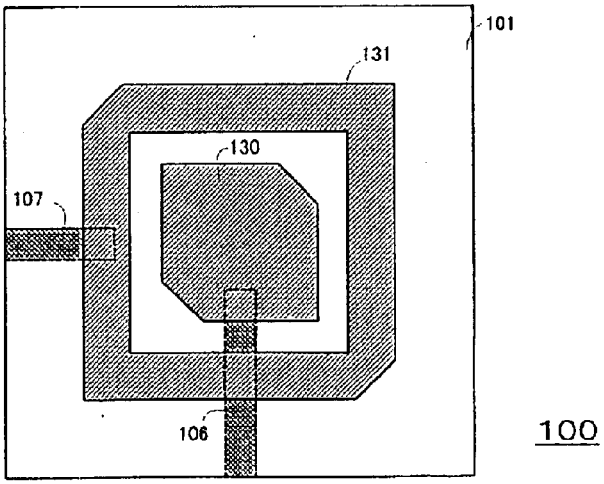

FIG. 5C is an example of using two circularly polarized wave patch antennas 130 and 131 as the first and second antenna electrodes, and similarly, the antenna 100 works as the circularly polarized wave antenna in the frequency band f1 and the frequency band f2. Thus, the circularly polarized wave antenna electrode may be used to receive and transmit the circularly polarized wave.

Figure 6A:
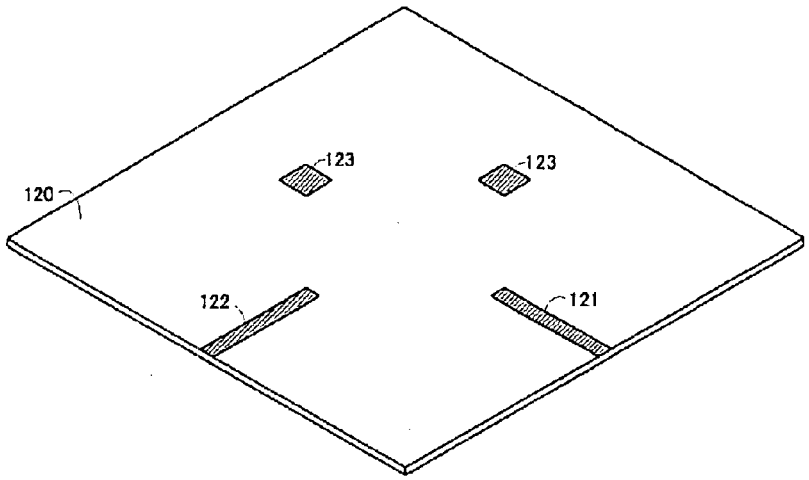
FIGS. 6A, 6B, and 6C are perspective views of substrates on which the antenna according to the first embodiment of the invention is mounted.
Figure 6B:
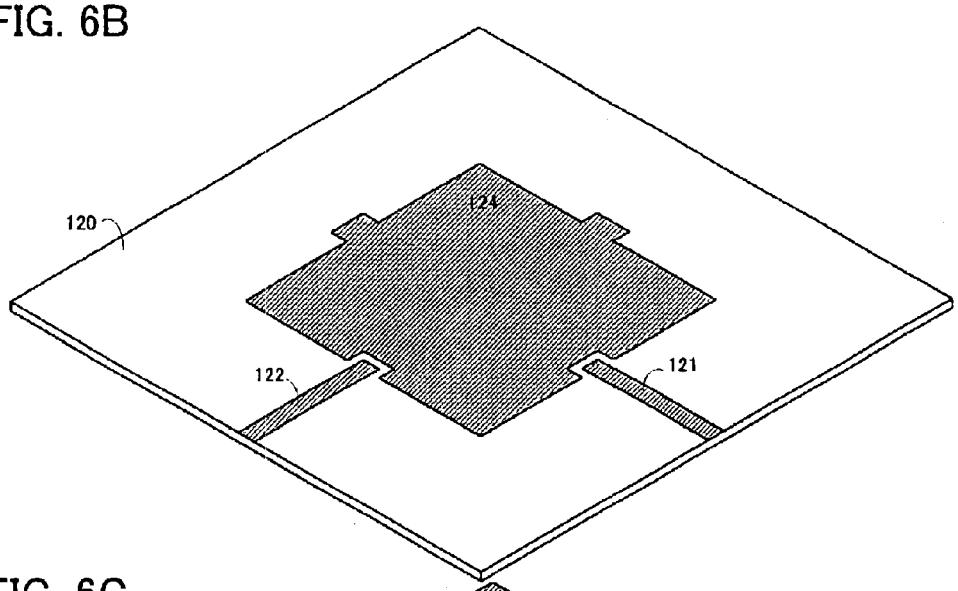
Figure 6C:
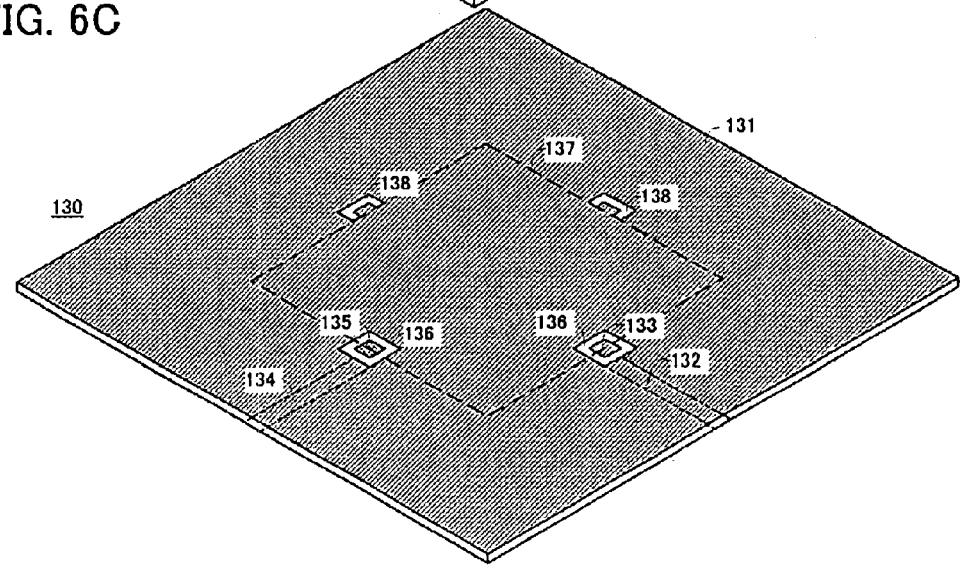

FIG. 6 is a perspective view of a substrate on which the antenna of the first embodiment of the invention is mounted. FIG. 6A is a perspective view of the substrate 120 shown in FIG. 2. FIG. 6B is an example with the ground pad 124 having the ground extended under the antenna. FIG. 6C is a perspective view of a substrate 130 designed in that the antenna can be mounted on the ground surface, and the substrate 130 includes a pad 133 for a first input/output line 132, a pad 135 for a second input/output line 134, gaps 136 for separating the respective two pads from the ground, and gaps 138 for improving the mounting performance of the ground terminal electrode when mounting the antenna at a position indicated by the dotted line 137. Thus, when using the electrode for the ground on the substrate 130, it is not necessary to provide the substrate with the ground electrode.

In the above-mentioned description, although the square is used as the cross section of the dielectric block 101 by way of example, rectangle, circle, ellipse, and polygon may be used. Although the square is used, by way of example, as the antenna electrode, rectangle, circle, ellipse, and polygon may be used.

Although the example of the high frequency H1 and the low frequency H2 equal to each other in the height of the feeding line has been described, the values different from each other may be used. In the case, a preferable characteristic can be obtained by using the condition shown in FIG. 3A.

Figure 7:
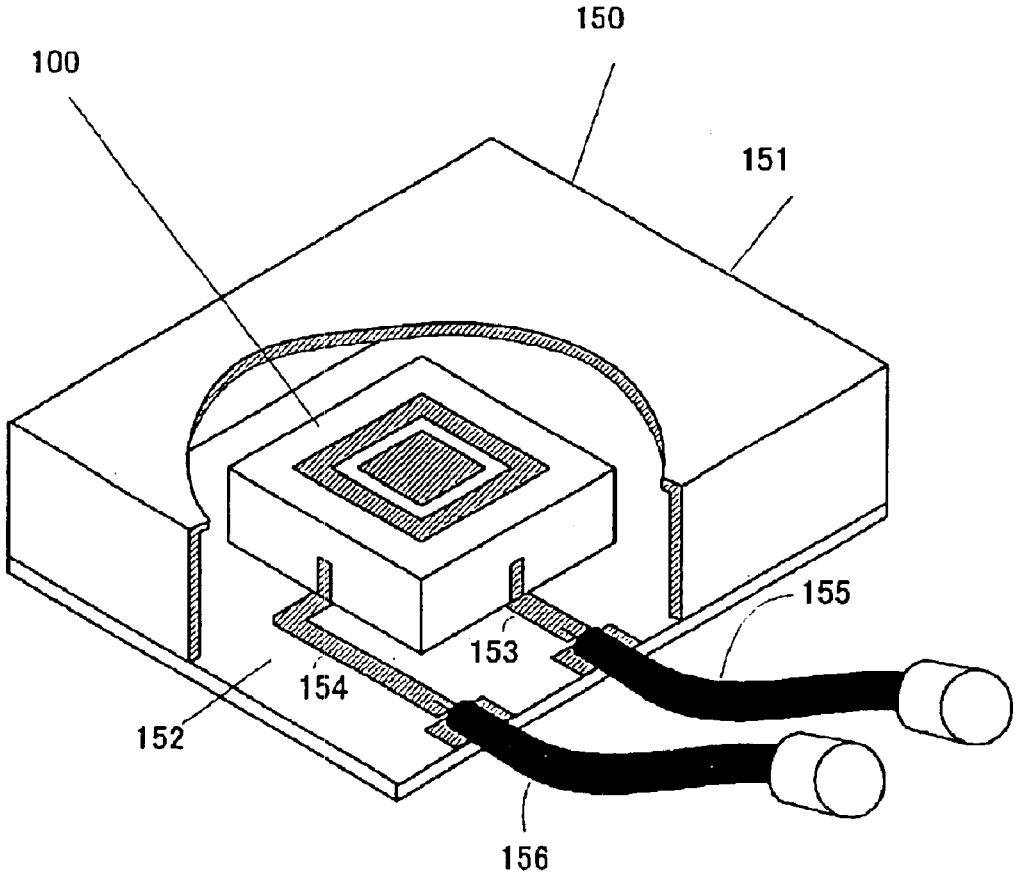
FIG. 7 is a perspective view of an antenna module using the antenna according to the first embodiment of the invention.

FIG. 7 is a perspective view of an antenna module 150 using the antenna 100 according to the first embodiment 1 with one portion cut off. The antenna 100 is formed on the substrate 152 and covered by an antenna cover 151. A high frequency feeding line 153 and a low frequency feeding line 154 are formed on the lateral side of the antenna 100, so to receive the power through the coaxial lines respectively from a connector cable 155 for the high frequency band f1 and a connector cable 156 for the low frequency band f2. Since the antenna module 150 of this structure is covered by the antenna cover 151, the environment around the antenna is firm and a stable antenna operation can be obtained.

Figure 8:
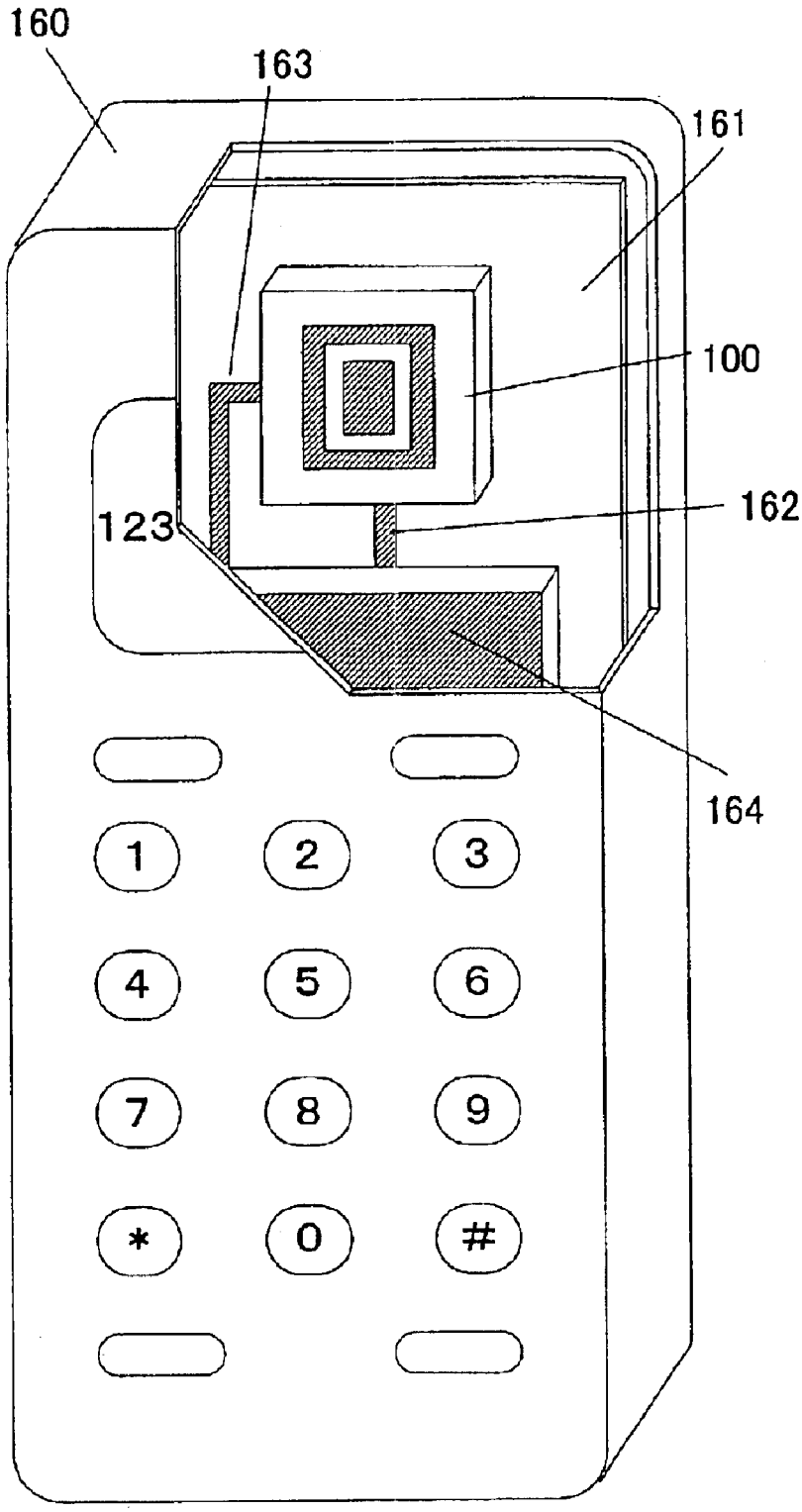
FIG. 8 is a perspective view of a radio device using the antenna according to the first embodiment of the invention.

FIG. 8 is a perspective view of a radio 160 using the antenna 100 according to the first embodiment. The antenna 100 is formed on a radio unit substrate 161, and a signal of the high frequency band f1 is received and supplied by a radio unit 164 from and to the antenna 100 through the high frequency input/output line 162. Similarly, a signal of the low frequency band f2 is received and supplied through the low frequency input/output line 163. The radio unit 164 is a circuit system for performing the operation of the radio 160, and it can be mounted on the radio unit substrate 161 together with the antenna 100 in the same method as the other surface-mount components, and the radio of stable characteristic can be manufactured at a lower cost.

2. Second Exemplary Embodiment

Figure 9A:
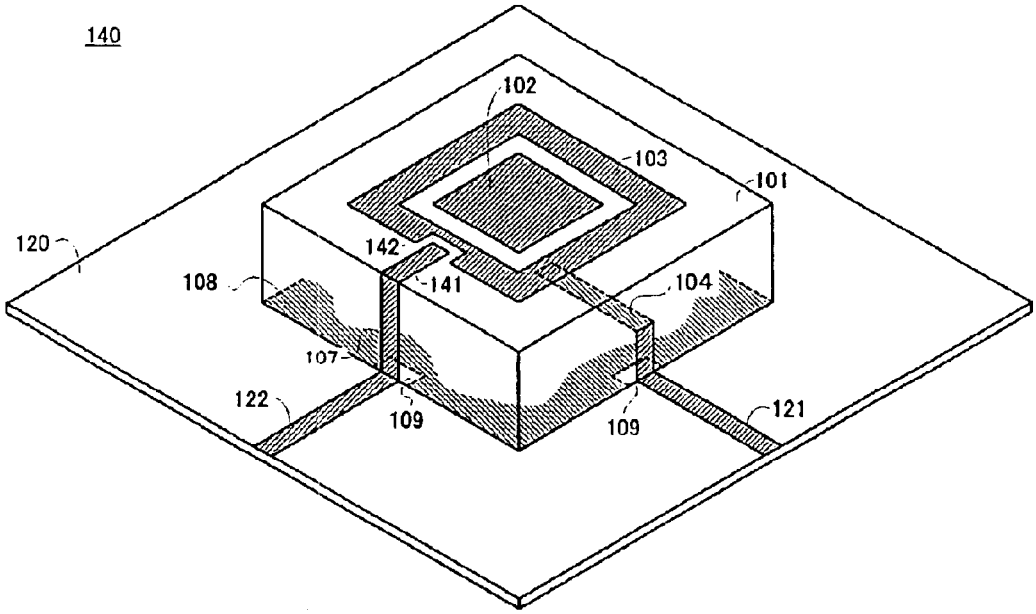
FIG. 9A is a perspective view of an antenna according to a second embodiment of the invention.
Figure 9B:
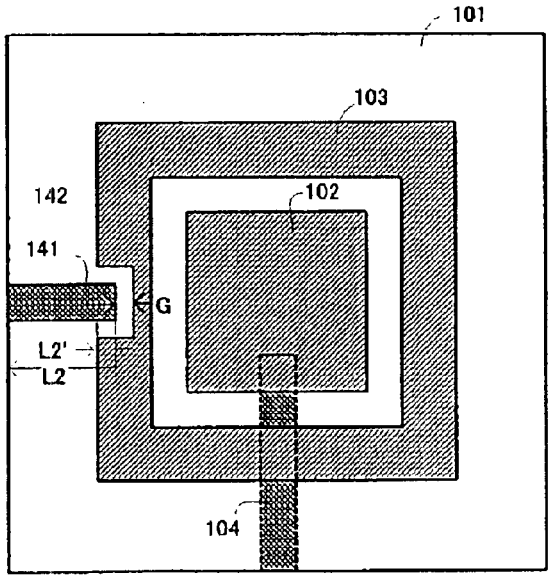
FIG. 9B is a top view of electrode arrangement in the antenna of FIG. 9A.

In FIGS. 9A and 9B, the antenna 140 comprises a low frequency feeding line electrode 141 whose length is L2 and which is formed on one main surface of the dielectric block 101. The low frequency feeding line electrode 141 is electromagnetically connected to the patch antenna electrode 103 with a gap 142 of the width G. The other portion is the same as that of the FIG. 2 and FIG. 3A.

The operation as for the signal of the frequency band f1 is the same as in the case of the first embodiment. A transmission signal of the low frequency band f2 is transmitted from the low frequency input/output line 122 to the low frequency feeding line electrode 141 after passing through the low frequency feeding terminal electrode 105, so to oscillate the low frequency patch antenna electrode 103 electromagnetically connected to the low frequency feeding line electrode 141 with the gap 142, and the signal is transmitted as a radio wave by the resonance of the low frequency patch antenna electrode 103. At the receiving time, the low frequency patch antenna electrode 103 is resonated and oscillated by the coming radio wave of the low frequency band f2, and the radio wave is transmitted to the low frequency feeding line electrode 141 electromagnetically connected with the gap 142, and supplied to the low frequency input/output line 122 after passing through the low frequency feeding terminal electrode 105.

As mentioned above, the antenna 140 operates as a dual-resonant antenna capable of transmission and reception of the signals of the frequency bands f1 and f2. The input impedance of the antenna 140 can be adjusted by adjusting the length L2 (or the length L2' of FIG. 9B) of the low frequency feeding line and the width G of the gap 142, thereby obtaining more preferable antenna characteristic.

As mentioned above, a good impedance characteristic can be obtained in the two frequencies, thereby realizing the dual-resonant antenna corresponding to the surface mounting.

3. Third Exemplary Embodiment

Figure 10A:
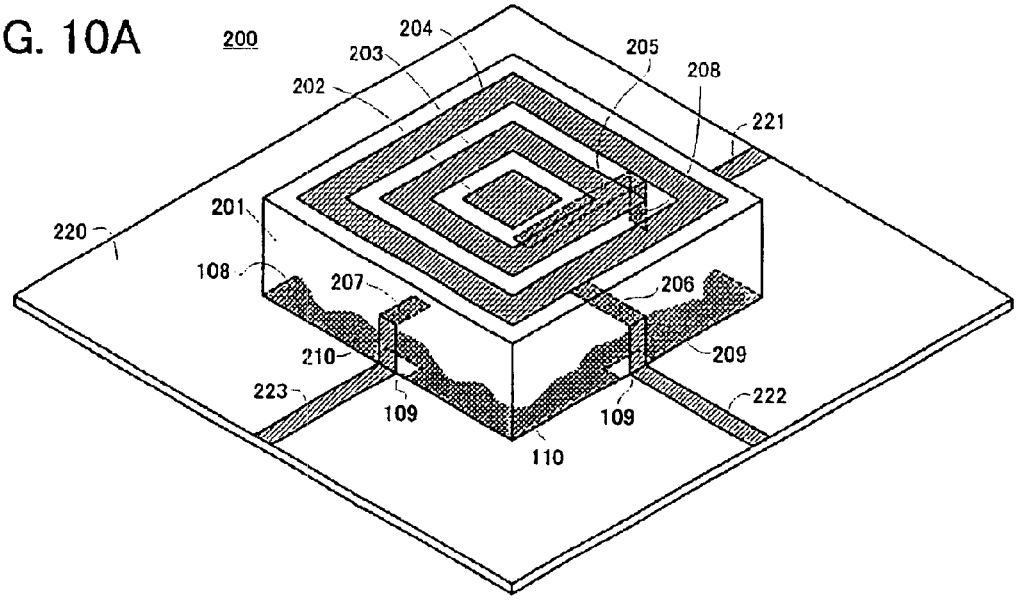
FIG. 10A is a perspective view of an antenna according to a third embodiment of the invention.
Figure 10B:
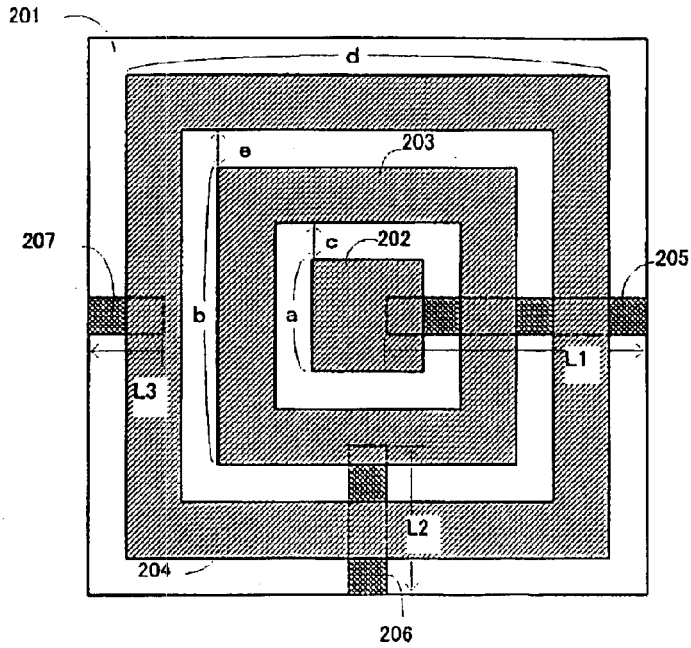
FIG. 10B is a top view of electrode arrangement in the antenna of FIG. 10A.

A third embodiment is an antenna 200 capable of coping with three frequency bands of f1, f2, and f3 (f1>f2>f3). In FIGS. 10A and 10B, the antenna 200 is provided with a high frequency patch antenna electrode 202 for the high frequency band f1, a medium frequency patch antenna electrode 203 for the medium frequency band f2, and a low frequency patch antenna electrode 204 for the low frequency band f3 on the main surface of the plate-shaped dielectric block 201 whose horizontal cross section is square. The high frequency patch antenna electrode 202 is a square electrode having each side of the length a, formed in the thick film printing. The medium frequency patch antenna electrode 203 is separated from the high frequency patch antenna electrode 202 by the space of the width c, and it is a square electrode having each side of the length b, formed in the thick film printing in a manner of embracing the high frequency patch antenna electrode 202. The low frequency patch antenna electrode 204 is separated from the medium frequency patch antenna electrode 203 by the space of the width e, and it is a square electrode having each side of the length d, formed in the thick film printing in a manner of embracing the medium frequency patch antenna electrode 203.

A high frequency feeding line electrode 205 that is the strip line-shaped internal layer electrode whose length is L1 is electromagnetically connected with the high frequency patch antenna electrode 202, a medium frequency feeding line electrode 206 that is the strip line-shaped internal layer electrode whose length is L2 is electromagnetically connected with the medium frequency patch antenna electrode 203, and a low frequency feeding line electrode 207 that is the strip line-shaped internal layer electrode whose length is L3 is electromagnetically connected with the low frequency patch antenna electrode 204.

On the lateral side and the bottom side of the dielectric block 201, there are formed a high frequency feeding terminal electrode 208 that is an input/output terminal for the high frequency band f1 of the antenna 200 and a fixing terminal at the surface mounting, which is connected to the high frequency feeding line electrode 205, a medium frequency feeding terminal electrode 209 that is an input/output terminal for the medium frequency band f2 of the antenna 200 and a fixing terminal at the surface mounting, which is connected to the medium frequency feeding line electrode 206, and a low frequency feeding terminal electrode 210 that is an input/output terminal for the low frequency band f3 of the antenna 200 and a fixing terminal at the surface mounting, which is connected to the low frequency feeding line electrode 207.

The operation as for the signals of the frequency bands f1 and f2 is the same as in the case of the first embodiment. The transmission signal of the low frequency band f3 passes through the low frequency input/output line 223, the low frequency feeding terminal electrode 210, and the low frequency feeding line electrode 207, so to oscillate the low frequency patch antenna electrode 204 and then, it is transmitted as a radio wave. At the receiving time, the low frequency patch antenna electrode 204 is oscillated by the coming radio wave of the low frequency band f3, and supplied to the low frequency input/output line 223 through the low frequency feeding line electrode 207, and the low frequency feeding terminal electrode 210.

As mentioned above, a good characteristic can be obtained in the three frequency bands, thereby realizing the antenna corresponding to the surface mounting.

Further, a dielectric patch antenna provided for transmission and reception of the frequency bands f4, f5, . . . (f3>f4>f5 . . . ) may be formed on the antenna substrate constituted in FIGS. 10A and 10B in a way of embracing each patch antenna electrode and the respective feeding terminal electrodes and feeding line electrodes are formed for the respectively corresponding patch antenna electrodes of the frequency bands f1, f2, f3, f4, f5 . . . . Therefore, it is possible to realize the antenna corresponding to the surface mounting capable of obtaining a good characteristic even at four and more frequencies.

4. Fourth Exemplary Embodiment

Figure 11A:
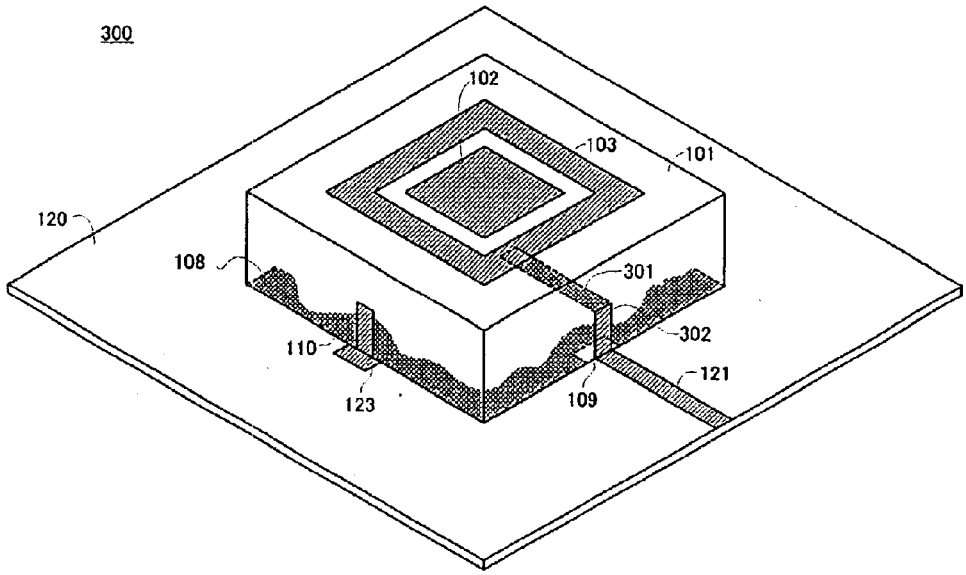
FIG. 11A is a perspective view of an antenna according to a fourth embodiment of the invention.
Figure 11B:
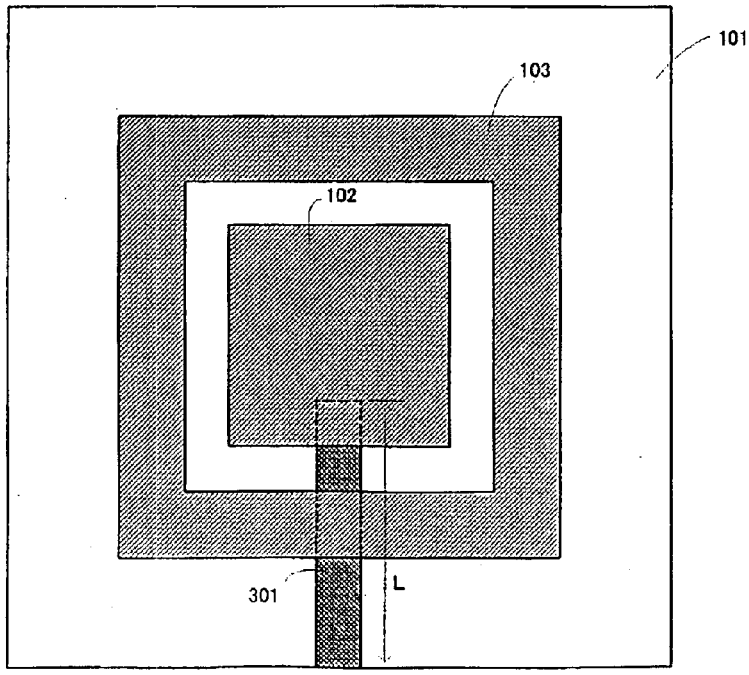
FIG. 11B is a top view of electrode arrangement in the antenna of FIG. 11A.

A fourth embodiment is an embodiment with one antenna output. In FIGS. 11A and 11B, an antenna 300 comprises a feeding line electrode 301 whose length is L and which is electromagnetically connected with the antenna electrodes 102 and 103, for feeding, and a feeding terminal electrode 302 that is an input/output terminal of the antenna 300 connected with the feeding line electrode 301 and a fixing terminal at the surface mounting, which is formed on the lateral side and the bottom side of the dielectric block 101. The other portion is the same as in FIG. 2 and FIG. 3A.

A transmission signal of the high frequency band f1 is transmitted to the feeding line electrode 301 from the input/output line 121 through the feeding terminal electrode 302, so to oscillate and resonate the high frequency patch antenna electrode 102, and then it is transmitted as a radio wave. At the receiving time, the high frequency patch antenna electrode 102 is resonated and oscillated by the coming radio wave of the high frequency band f1, transmitted to the feeding line electrode 301 electromagnetically connected with the high frequency patch antenna electrode 102, and supplied to the input/output line 121 after passing through the feeding terminal electrode 302. Similarly, a transmission signal of the low frequency band f2 is also received and transmitted. Thus, the antenna 300 operates as a dual-resonant antenna capable of transmission and reception of the signals of the frequency bands f1 and f2.

FIG. 12 is an analytic example of an input impedance in the feeding terminal electrode of the antenna in the case where the dielectric block 101 has a square cross section whose one side is 42 mm, the thickness of 5 mm, the specific inductive capacity of 7, a=20 mm, b=30 mm, and c=1 mm. The frequency band f1 uses the band of 2.5 GHz, the frequency band f2 uses the band of 1.5 GHz, and the VSWR uses the value corresponding to the 50Ω system.

Figure 12A:
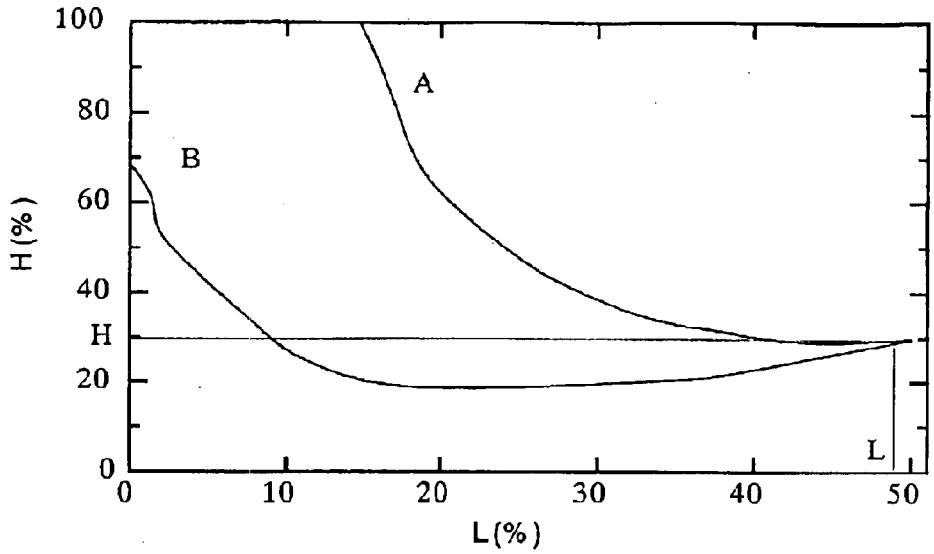
FIGS. 12A and 12B are views showing the characteristic examples of the antenna according to the fourth embodiment of the invention.

FIG. 12A is a graph showing the value L obtained by standardizing the length of the feeding line by the length b of the low frequency antenna electrode, in the horizontal axis and the value H obtained by standardizing the height from the bottom surface of the feeding line by the thickness of the dielectric block 101, in the vertical axis. A curve A is a trace of the condition in which the VSWR of the input impedance of the feeding terminal electrode 302 becomes 1 in the high frequency band f1. A curve B is a trace of the condition in which the VSWR of the input impedance of the feeding terminal electrode 302 becomes 1 in the frequency band f2. For example, when the height from the bottom surface of the feeding line is H=30%, both the trances A and B become L=49%.

Figure 12B:
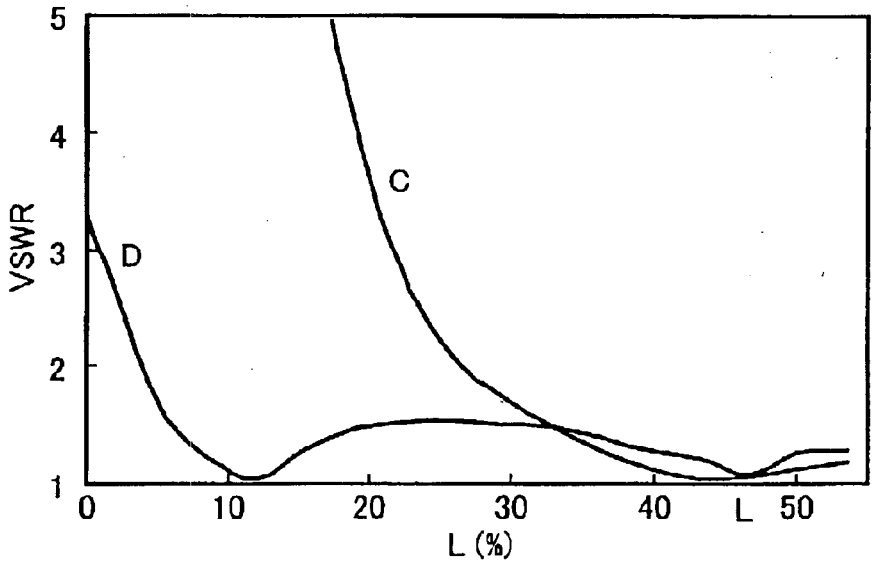

FIG. 12B is an analytic example in the case where the standard height of the feeding line is H=30%, with the standard length L of the feeding line shown in the horizontal axis and the VSWR shown in the vertical axis. The trace C shows the relationship between the standard length L of the feeding line and the VSWR characteristic in the frequency band f1, and it shows that a good impedance characteristic can be obtained when the standard length L is about 49%. The trace D shows an example of the relationship between the standard length L of the feeding line and the VSWR characteristic in the frequency band f2, and it shows that a good impedance characteristic can be obtained when the standard length L is about 49%.

According to the embodiment, since the antenna output is only one, the number of necessary cables has only to be one in the structure of connecting the antenna and the radio module which are separated from each other, via a cable, thereby forming the radio unit at a low cost.

As mentioned above, a good impedance characteristic can be obtained at the two frequencies and the dual-resonant antenna corresponding to the surface mounting of the single input and output can be realized.

5. Fifth Exemplary Embodiment

Figure 13A:
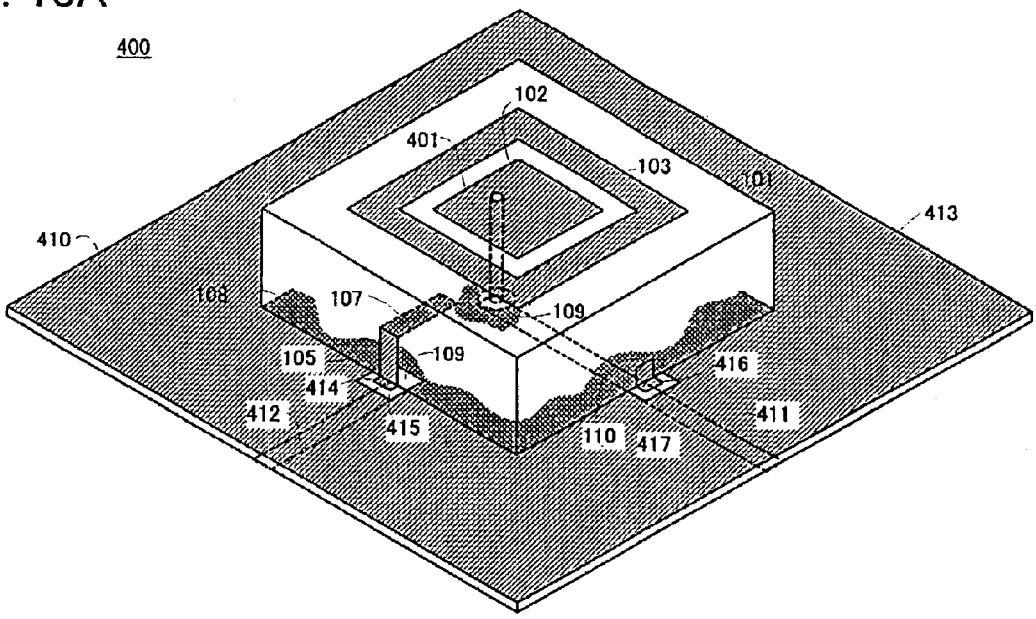
FIG. 13A is a perspective view of an antenna according to a fifth embodiment of the invention.
Figure 13B:
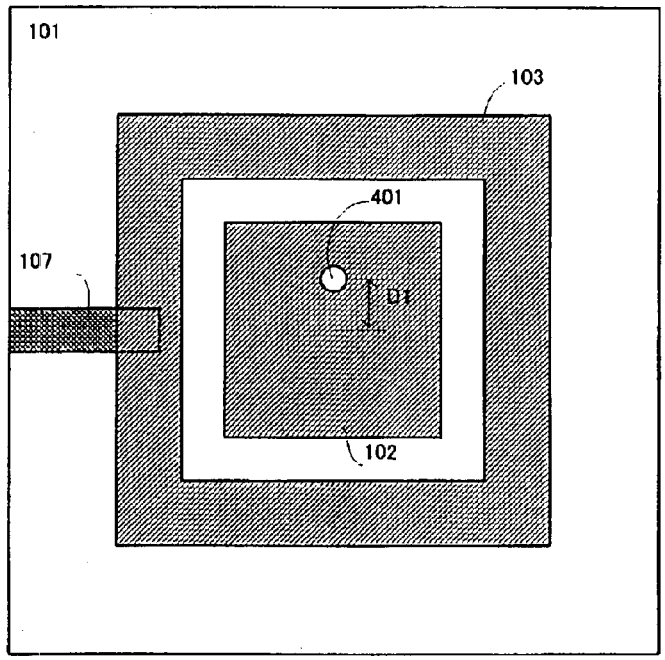
FIG. 13B is a top view of electrode arrangement in the antenna of FIG. 13A.

In FIGS. 13A and 13B, an antenna 400 is mounted on a substrate 410. A feeding pin 401 which penetrates the dielectric block 101, to be connected to the antenna electrode 102, is formed, and a high frequency input/output line 411 and a low frequency input/output line 412 that are formed by micro-strip lines for feeding power to the antenna 400 are connected to the feeding pin 401.

By connecting the feeding pin 401 to the input/output line 411, the feeding terminal electrode 107 to the end of the input/output line 412, and the ground terminal electrode 110 to a ground pad 416 connected with a ground 413, respectively, by the soldering, the antenna 400 is surface-mounted on the substrate 120. The other portion is the same as in FIG. 2 and FIG. 3A.

A transmission signal of the high frequency band f1 oscillates the high frequency patch antenna electrode 102 after passing through the high frequency input/output line 411 and the feeding pin 401, and it is transmitted as a radio wave by the resonance of the high frequency patch antenna electrode 102. At the receiving time, the high frequency patch antenna electrode 102 is resonated and oscillated by the coming radio wave of the high frequency band f1, and the radio wave is transmitted to the feeding pin 401 and supplied to the high frequency input/output line 411. A transmission signal of the low frequency band f2 is received and transmitted similarly to the embodiment 1, and the antenna operates as a dual-resonant antenna capable of receiving and transmitting the signals of the frequency bands f1 and f2.

In this embodiment, by adjusting the position of connecting the feeding pin 401 with the high frequency antenna electrode 102 (D1 in FIG. 13B), the impedance can be adjusted and a good antenna characteristic can be obtained. Further, by fixing the antenna 400 on the substrate 410 by the feeding pin 401, the fixed power of the antenna 400 can be increased.

As mentioned above, a good impedance can be obtained at the two frequencies, and a dual-resonant antenna enforced in the fixed power can be realized.

6. Sixth Exemplary Embodiment

Figure 14A:
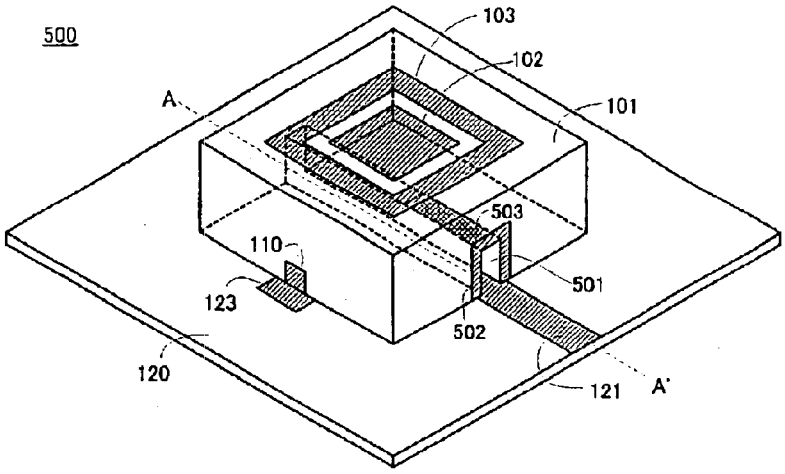
FIG. 14A is a perspective view of an antenna according to a sixth embodiment of the invention.
Figure 14B:
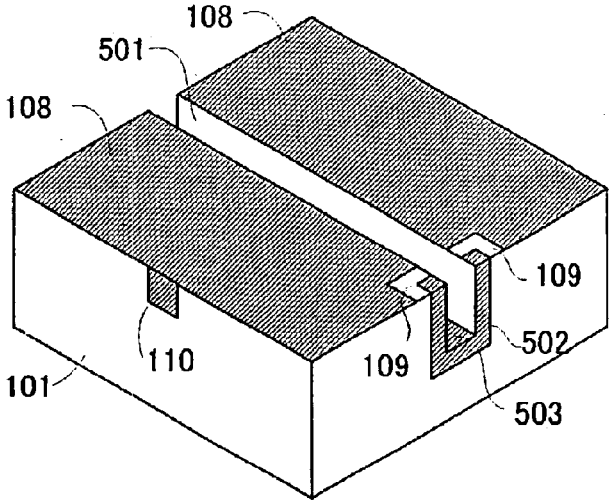
FIG. 14B is a perspective view from the back surface of the antenna of FIG. 14A.
Figure 14C:
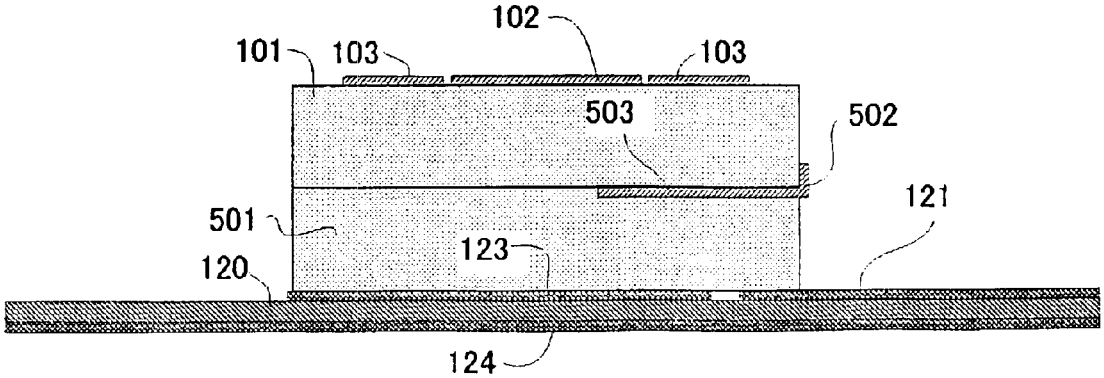
FIG. 14C is an A–A' line-cross sectional view of FIG. 14A.

In FIGS. 14A to 14C, a feeding line groove 501 is provided on the bottom surface of the dielectric block 101, and a feeding line electrode 502 is formed on the ceiling of the feeding line groove 501. A feeding terminal electrode 503 that is an input/output terminal is connected to the feeding line electrode 502. The other portion is the same as in FIG. 2 and FIG. 3A.

The transmission and reception at the frequency bands f1 and f2 is the same as in the fourth embodiment. By providing the feeding line electrode 502 within the feeding line groove 501, for example, the dielectric ceramic having a hollow or groove can be used as the dielectric block 101, which makes it easy to manufacture the antenna 700. Adjusting the feeding line electrode 502 by the laser processing enables adjustment after forming the antenna.

Further, by providing the patch antenna electrodes 102 and 103 and the feeding line electrode 502 on the top surface of the dielectric block 101, it is possible to change the shape of the electrode after forming the dielectric block 101 and cope with a desired frequency at ease. For example, when forming the dielectric block 101 by the dielectric ceramic, one kind of dielectric block 101 can be used to realize the antenna for different frequencies at ease.

As mentioned above, a good impedance characteristic can be obtained at the two frequencies and a dual resonant antenna of one point feeding, which can be manufactured easily, can be realized.

7. Seventh Exemplary Embodiment

Figure 15A:
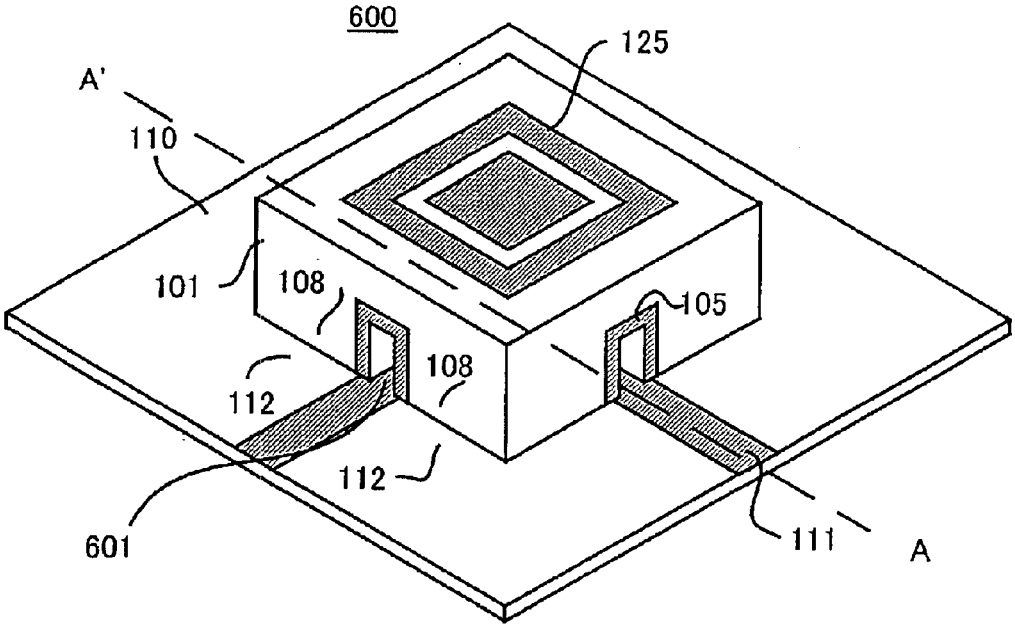
FIG. 15A is a perspective view of an antenna according to a seventh embodiment of the invention.
Figure 15B:
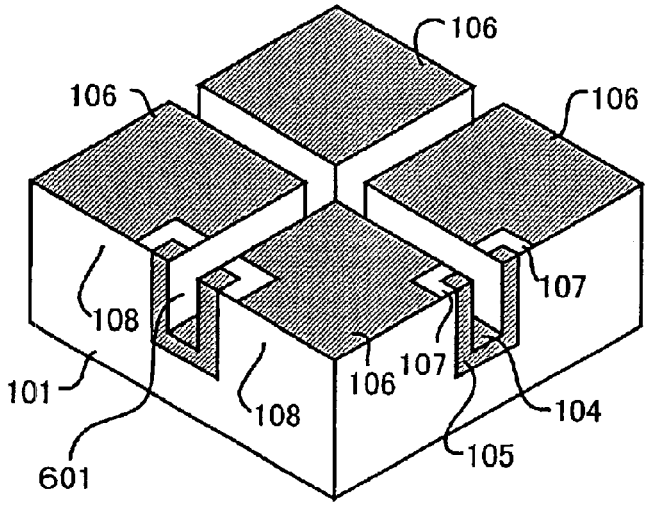
FIG. 15B is a perspective view from the back surface of the antenna of FIG. 15A.
Figure 15C:
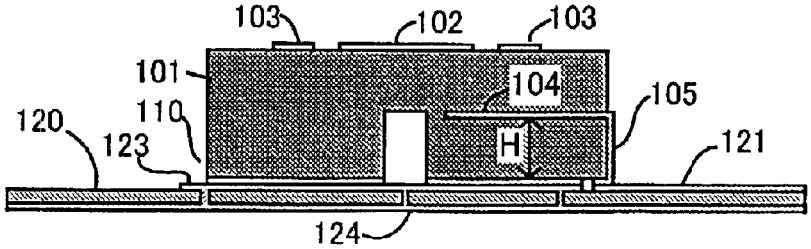
FIG. 15C is an A–A' line-cross sectional view of FIG. 15A.

In FIGS. 15A to 15C, a cross-shaped feeding line groove 601 is provided on the bottom of the dielectric block 101 and a feeding line electrode 105 is formed on the ceiling of the feeding line groove 601. A feeding terminal electrode 104 that is an input/output terminal is connected with the feeding line electrode 105. The other portion is the same as in FIG. 2 and FIG. 3A.

The transmission and reception at the frequency bands f1 and f2 is the same as in the first embodiment.

By providing the feeding line electrode 105 within the feeding line groove 601, for example, the dielectric ceramic having a hollow or groove can be used as the dielectric block 101, which makes it easy to manufacture the antenna.

As mentioned above, a good impedance characteristic can be obtained at the two frequencies and a dual resonant antenna of two point feeding, which can be manufactured easily, can be realized.

8. Eighth Exemplary Embodiment

Figure 16:
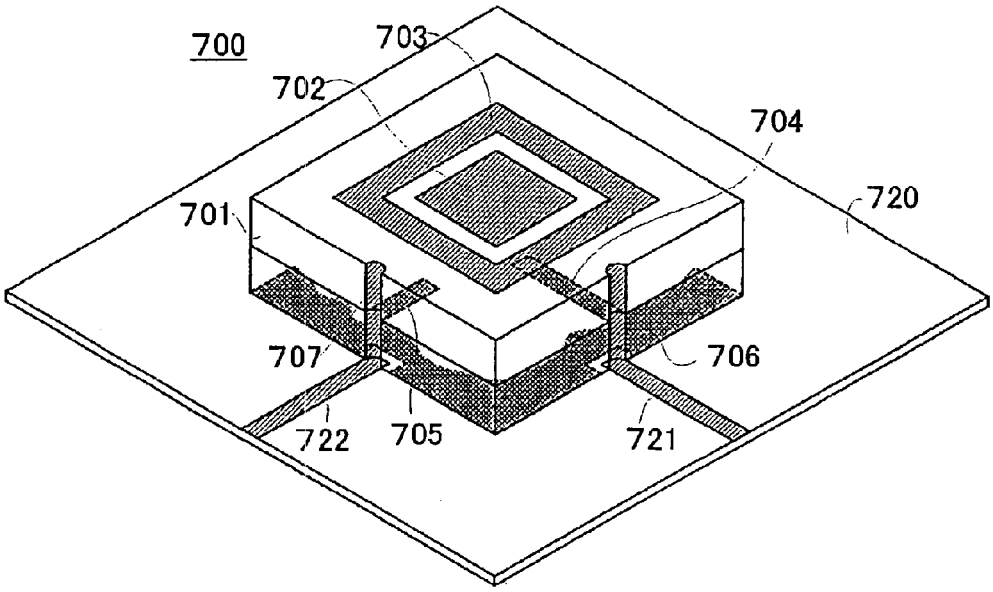
FIG. 16 is a perspective view of an antenna according to an eighth embodiment of the invention.

An eighth embodiment is an example of an antenna 700 capable of coping with three frequency bands of f1, f2, and f3 (f1>f2>f3). In FIG. 16, the antenna 500 comprises a high frequency patch antenna electrode 502 for the high frequency band f1 and a low frequency patch antenna electrode 503 for the low frequency band f2 patterned by the etching on the main surface of a dielectric block 501 formed by a dielectric composite substrate whose horizontal cross section is a square. The high frequency patch antenna electrode 502 is a square electrode whose one side is of the length a and the low frequency patch antenna electrode 503 is separated from the high frequency patch antenna electrode 502 by the space of the width c, and it is a square electrode whose one side is of the length b, formed in a way of embracing the high frequency patch antenna electrode 502.

A high frequency feeding line electrode 504 that is a strip line-shaped internal layer electrode of the length L1 is electromagnetically connected with the high frequency patch antenna electrode 502 and a medium frequency feeding line electrode 505 that is a strip line-shaped internal layer electrode of the length L2 is electromagnetically connected with the low frequency patch antenna electrode 503.

On the lateral side and the bottom side of the dielectric block 501, there are formed a high frequency feeding terminal electrode 506 that is an input/output terminal for the high frequency band f1 of the antenna 500 and a fixing terminal at the surface mounting, which is formed by the side metalize and connected to the high frequency feeding line electrode 504, and a low frequency feeding terminal electrode 507 that is an input/output terminal for the low frequency band f2 of the antenna 500 and a fixing terminal at the surface mounting, which is connected to the low frequency feeding line electrode 505.

The antenna 500 is surface-mounted on the substrate 120 by connecting the feeding terminal electrode 506 and the feeding terminal electrode 507 respectively to the end of the input/output line 121 and the end of the input/output line 122 by soldering.

The operation as for the frequency bands f1 and f2 is the same as in the first embodiment. According to this structure, a multiple-resonant antenna can be manufactured by the usual multi-layer substrate manufacturing method.

9. Ninth Exemplary Embodiment

Figure 17:
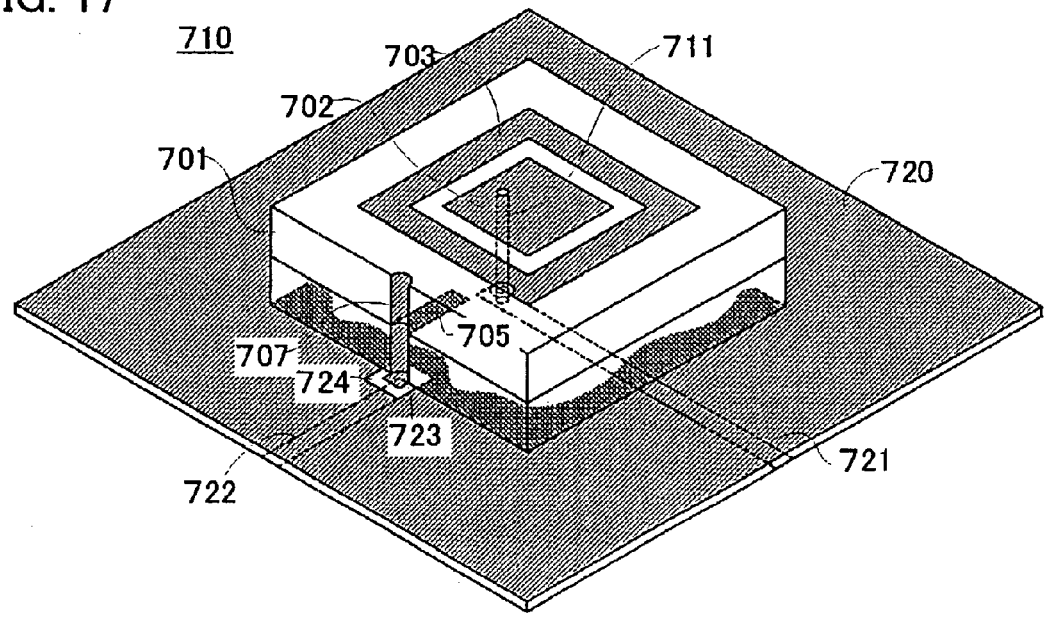
FIG. 17 is a perspective view of an antenna according to a ninth embodiment of the invention.

FIG. 17 shows an antenna of a ninth embodiment. The antenna 510 of the embodiment supplies the signal from a feeding pin 511 of the through hole to a high frequency patch antenna electrode 502. The other structure and operation are identical to the eighth embodiment described in FIG. 16. A good impedance characteristic can be obtained by adjusting the position of the feeding pin 511.

10. Tenth Exemplary Embodiment

Figure 18:
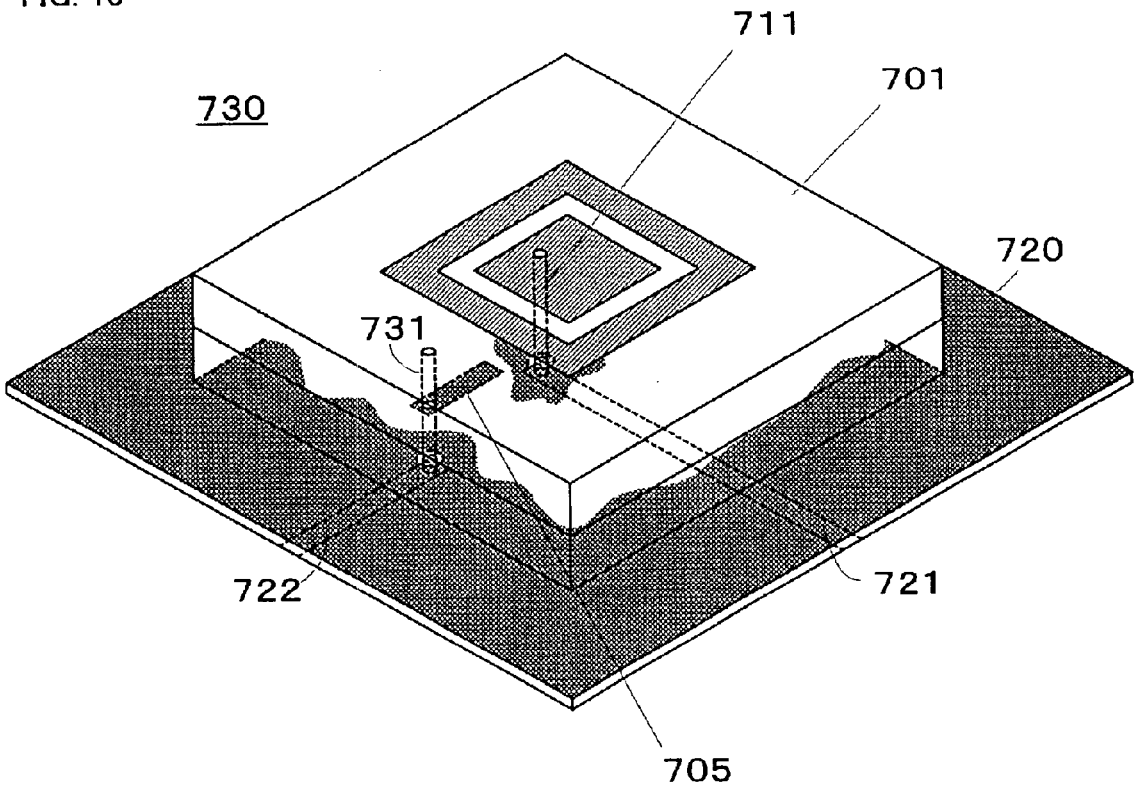
FIG. 18 is a perspective view of an antenna according to a tenth embodiment of the invention.

FIG. 18 shows an antenna of a tenth embodiment. The antenna 530 of the embodiment supplies the signal to a low frequency feeding line electrode 505 from a feeding terminal electrode 531 via the through hole. The other structure and operation are identical to the ninth embodiment described in FIG. 17. Also in the embodiment, a good impedance characteristic can be obtained by adjusting the position of the feeding pin 511.

11. Eleventh Exemplary Embodiment

Figure 19A:
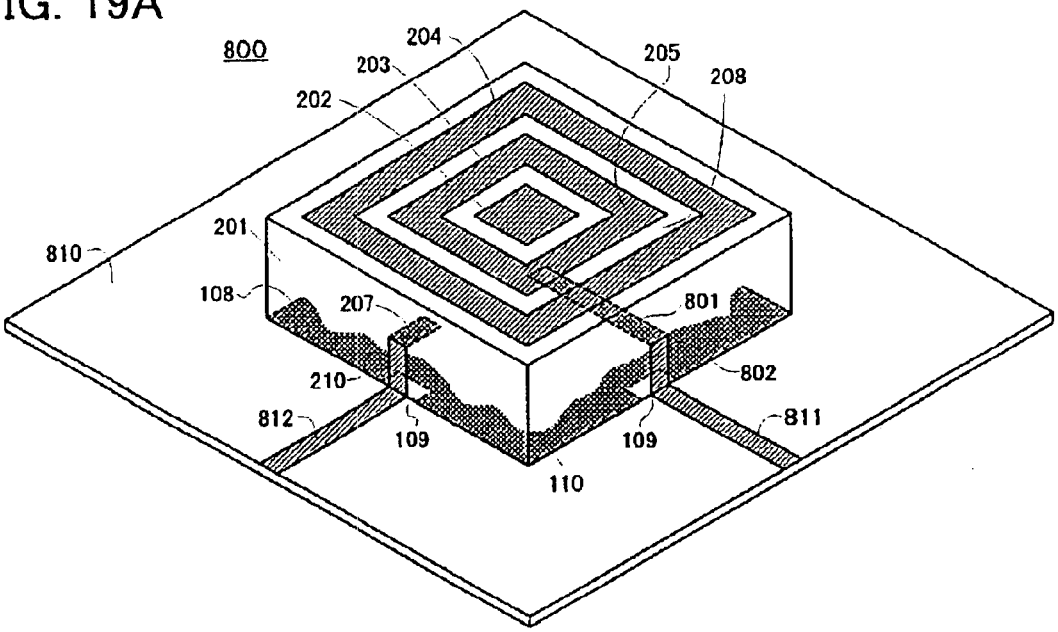
FIG. 19A is a perspective view of an antenna according to an eleventh embodiment of the invention.

An eleventh embodiment is an example of sharing a feeding line electrode in two frequency bands, and FIG. 19A shows a perspective view in the substrate mounting state. In FIG. 19A, the same reference numeral is attached to the same portion as that of FIG. 10 and the description thereof is omitted.

An antenna 800 is an antenna corresponding to the frequency bands f1, f2, and f3 (f1>f2>f3) and it comprises a high frequency patch antenna electrode 202 for the high frequency band f1, a medium frequency patch antenna electrode 203 for the medium frequency band f2, and a low frequency patch antenna electrode 204 for the low frequency band f3 on the main surface of the plate-shaped dielectric block 201 whose horizontal cross section is a square.

A high/medium frequency feeding line electrode 801 that is a strip line-shaped internal layer electrode of the length L1 is electromagnetically connected to the high frequency patch antenna electrode 202 and the medium frequency patch antenna electrode 203, and a high/medium frequency feeding terminal electrode 802 that is an input/output terminal for the high frequency band f1 and the medium frequency band f2 and a fixing terminal at the surface mounting is formed on the lateral side and the bottom side of the dielectric block 201 and connected with the high/medium frequency feeding line electrode 801. A high/medium frequency input/output line 811 is connected with the high/medium frequency feeding terminal electrode 802.

Figure 19B:
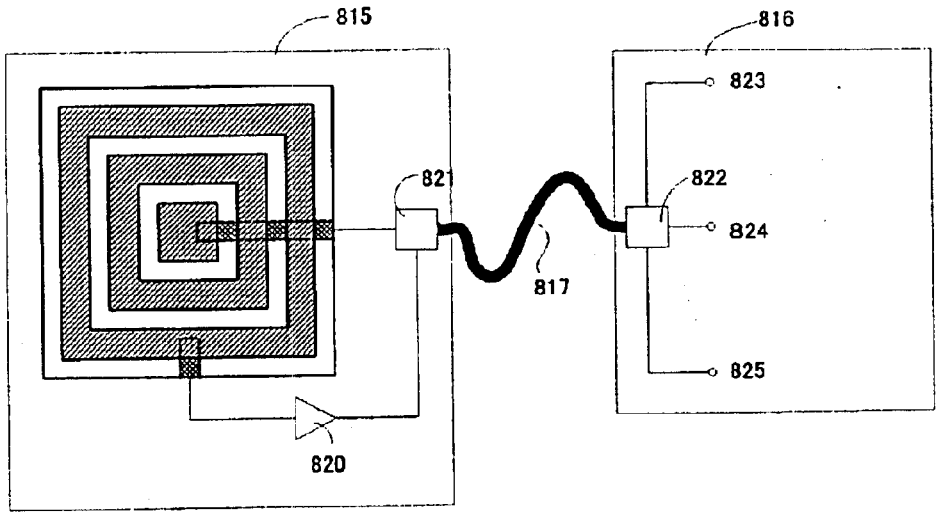
FIG. 19B is a function block diagram of a radio structure using the antenna according to the eleventh embodiment of the invention.

FIG. 19B is a function block diagram of a radio unit structure using this antenna. An antenna portion 815 including the antenna 800 has a lower frequency low noise amplifier 820 and an antenna sharing unit 821, and the antenna sharing unit 821 and a divider 822 of the radio unit 816 are connected by a cable 817. The output of the divider 822 is distributed to a connection port 823 with the high frequency radio unit, a connection port 824 with the medium frequency radio unit, and a connection port 825 with the low frequency radio unit.

The basic operation is the same as that of the third embodiment, and a different point from the third embodiment will be described later. A transmission signal of the high frequency band f1 passes through the high/medium frequency input/output line 811, the high/medium frequency feeding terminal electrode 802, and the high/medium frequency feeding line electrode 801, hence to oscillate the high frequency patch antenna electrode 202 and it is transmitted as a radio wave. Further, a transmission signal of the medium frequency band f2 passes through the high/medium frequency input/output line 811, the high/medium frequency feeding terminal electrode 802, and the high/medium frequency feeding line electrode 801, hence to oscillate the medium frequency patch antenna electrode 203 and it is transmitted as a radio wave.

At the receiving time, the high frequency patch antenna electrode 202 is oscillate by the coming radio wave of the high frequency band f1, and supplied to the high/medium frequency input/output line 811 after passing through the high/medium frequency feeding line electrode 801 and the high/medium frequency feeding terminal electrode 802. The medium frequency patch antenna electrode 203 is oscillated by the coming radio wave of the medium frequency band f2, and supplied to the high/medium frequency input/output line 811 after passing through the high/medium frequency feeding electrode 801 and the high/medium frequency feeding terminal electrode 802. The operation as for the signal of the frequency band f3 is as described in the third embodiment.

In the structure of FIG. 19B, a radio unit receiving a small signal, for example, like GPS and having only a receiving function is assumed as a system using the low band. A good matching with the low noise amplifier 820 for low frequency can be achieved by adjusting impedance by the length of the low frequency feeding line electrode and the structure of a more sensitive receiver can be realized. Further, an antenna sharing circuit between the high frequency and the medium frequency is not required, a good matching with, for example the 50Ω system can be achieved by the same operation as the fourth embodiment, and the structure of a more efficient antenna unit can be realized.

Although the example of sharing the feeding line electrode between the high frequency band and the medium frequency band has been described in this embodiment, the feeding line electrode may be shared between the high frequency band the low frequency band, or between the medium frequency band and the low frequency band.

As mentioned above, a good characteristic can be achieved in the three frequency bands and an antenna corresponding to the surface mounting can be realized.

What is claimed is:

1. A multiple-resonant antenna comprising:

a dielectric block;

a plurality of patch antenna electrodes formed on one main surface of the dielectric block;

one or a plurality of feeding terminal electrode formed on a lateral side of the dielectric block;

one or a plurality of feeding line electrode connected to the feeding terminal electrode so as to be electromagnetically connected to the patch antenna electrode;

a ground electrode on a bottom of the dielectric block, and at least a around terminal electrode connected to the ground electrode, which is formed on a lateral side of the dielectric block.

2. The multiple-resonant antenna, according claim 1, comprising the feeding terminal electrode that is a fixing terminal at a surface mounting time, formed on a lateral side of the dielectric block.

3. The multiple-resonant antenna, according to claim 1, wherein the feeding terminal electrode serves as a fixing terminal at a surface mounting time.

4. The multiple-resonant antenna, according to claim 1, wherein the dielectric block has a square horizontal cross section.

5. A multiple-resonant antenna comprising:

a dielectric block;

a plurality of patch antenna electrodes formed on one main surface of the dielectric block;

one or a plurality of feeding terminal electrode formed on a lateral side or the dielectric block;

one or a plurality of feeding line electrode connected to the feeding terminal electrode so as to be electromagnetically connected to the patch antenna electrode;

a ground electrode on a bottom of the dielectric block; and a separating element formed by a space for separating the ground electrode and the feeding terminal electrode on the bottom of the dielectric block.

6. A multiple-resonant antenna comprising:

a dielectric block;

a plurality of patch antenna electrodes formed on one main surface of the dielectric block;

one or a plurality of feeding terminal electrode formed on a lateral side or the dielectric block; and one or a plurality of feeding line electrode connected to the feeding terminal electrode so as to be electromagnetically connected to the patch antenna electrode;

wherein the patch antenna electrode receives and transmits a circularly polarized wave.

7. A multiple-resonant antenna comprising:

a dielectric block;

a plurality of patch antenna electrodes formed on one main surface of the dielectric block;

one or a plurality of feeding terminal electrode formed on a lateral side of the dielectric block;

one or a plurality of feeding line electrode connected to the feeding terminal electrode so as to be electromagnetically connected to the patch antenna electrode; and a feeding line groove formed by a hollow provided on a bottom or a top of the dielectric block, which groove accommodates the feeding line electrode.

8. The multiple-resonant antenna, according to claim 7, wherein the feeding line groove has a shape of straight line.

9. The multiple-resonant antenna, according to claim 7, wherein the feeding line groove has a shape of cross.

10. The multiple-resonant antenna, according to claim 7, comprising a ground electrode that is a ground of the antenna, formed by a thin metal plate attached on the bottom of the dielectric block to cover the feeding line groove on the bottom of the dielectric block.

11. A multiple-resonant antenna comprising:

a dielectric block;

a plurality of patch antenna electrodes formed on one main surface of the dielectric block;

one or a plurality of feeding terminal electrode formed on a lateral side of the dielectric block; and one or a plurality of feeding line electrode connected to the feeding terminal electrode so as to be electromagnetically connected to the patch antenna electrode;

wherein the dielectric block is that one formed by a multi-layer substrate, including the feeding line electrode as an internal electrode and the feeding terminal electrode is formed by side metalize.

12. A multiple-resonant antenna comprising:

a dielectric block;

a plurality of patch antenna electrodes formed on one main surface of the dielectric block;

one or a plurality of feeding terminal electrode formed on a lateral side of the dielectric block; and one or a plurality of feeding line electrode connected to the feeding terminal electrode so as to be electromagnetically connected to the patch antenna electrode;

wherein the dielectric block is that one formed by a multi-layer substrate, including the feeding line electrode as an internal electrode and the feeding terminal electrode is formed by a through hole bored in a thickness direction of the dielectric block, so as to connect with an end of the feeding line.

13. A multiple-resonant antenna comprising:

a dielectric block;

a first patch antenna electrode formed on one main surface of the dielectric block, for receiving and transmitting a radio wave of a first frequency band;

a second patch antenna electrode formed on the same surface as the first patch antenna electrode apart therefrom in a manner of embracing the first patch antenna electrode, for receiving and transmitting a radio wave of a second frequency band lower than the first frequency band;

a first feeding line electrode electromagnetically connected to the first patch antenna electrode;

a second feeding line electrode electromagnetically connected to the second patch antenna electrode;

a first feeding terminal electrode formed on a lateral side of the dielectric block and connected to the first feeding line electrode; and a second feeding terminal electrode formed on a lateral side different from the side of the first feeding terminal electrode and connected to the second feeding line electrode.

14. The multiple-resonant antenna, according to claim 13, wherein the height of the first feeding line electrode from the bottom is equal to that of the second feeding line electrode from the bottom.

15. The multiple-resonant antenna, according to claim 13, wherein the first patch antenna electrode and the second patch antenna electrode are patch antennas for circularly polarized wave.

16. The multiple-resonant antenna, according to claim 15, wherein a cut-off portion is provided on one portion of the first patch antenna electrode.

17. The multiple-resonant antenna, according to claim 13, comprising a second feeding line electrode formed on the same surface of the dielectric block as the second patch antenna electrode and electromagnetically connected to the second patch antenna electrode with a space.

18. The multiple-resonant antenna, according to claim 13, wherein the second feeding terminal electrode serves as a fixing terminal at a surface mounting time.

19. The multiple-resonant antenna, according to claim 13, wherein the dielectric block has a square horizontal cross section.

20. A multiple-resonant antenna comprising:

a dielectric block;

a first patch antenna electrode formed on one main surface of the dielectric block, for receiving and transmitting a radio wave of a first frequency band;

a second patch antenna electrode formed on the same surface as the first patch antenna electrode apart from the first patch antenna electrode in a manner of embracing the first patch antenna electrode, for receiving and transmitting a radio wave of a second frequency band lower than the first frequency band;

a feeding line electrode electromagnetically connected to the first patch antenna electrode; and a feeding terminal electrode formed on a lateral side of the dielectric block and connected to the first feeding line electrode.

21. The multiple-resonant antenna, according to claim 20, wherein the dielectric block has a square horizontal cross section.

22. A multiple-resonant antenna comprising:

a dielectric block;

a first patch antenna electrode formed on one main surface of the dielectric block, for receiving and transmitting a radio wave of a first frequency band;

a second patch antenna electrode formed on the main surface of the dielectric block apart from the first patch antenna in a manner of embracing the first patch antenna electrode, for receiving and transmitting a radio wave of a second frequency band lower than the first frequency band;

a third patch antenna electrode formed on the main surface of the dielectric block apart from the second patch antenna electrode in a manner of embracing the second patch antenna electrode, for receiving and transmitting a radio wave of a third frequency band lower than the second frequency band;

a first feeding line electrode electromagnetically connected to the first patch antenna electrode;

a second feeding line electrode electromagnetically connected to the second patch antenna electrode;

a third feeding line electrode electromagnetically connected to the third patch antenna electrode;

a first feeding terminal electrode connected to the first feeding line electrode;

a second feeding terminal electrode connected to the second feeding line electrode;

a third feeding terminal electrode connected to the third feeding line electrode; and a feeding line electrode electromagnetically connected to the first patch antenna electrode and the third patch antenna electrode and a feeding terminal electrode connected to the feeding line electrode.

23. A multiple-resonant antenna comprising:

a dielectric block;

a first patch antenna electrode formed on one main surface of the dielectric block, for receiving and transmitting a radio wave of a first frequency band;

a second patch antenna electrode formed on the main surface of the dielectric block apart from the first patch antenna in a manner of embracing the first patch antenna electrode, for receiving and transmitting a radio wave of a second frequency band lower than the first frequency band;

a third patch antenna electrode formed on the main surface of the dielectric block apart from the second patch antenna electrode in a manner of embracing the second patch antenna electrode, for receiving and transmitting a radio wave of a third frequency band lower than the second frequency band;

a first feeding line electrode electromagnetically connected to the first patch antenna electrode;

a second feeding line electrode electromagnetically connected to the second patch antenna electrode;

a third feeding line electrode electromagnetically connected to the third patch antenna electrode;

a first feeding terminal electrode connected to the first feeding line electrode;

a second feeding terminal electrode connected to the second feeding line electrode;

a third feeding terminal electrode connected to the third feeding line electrode; and a feeding line electrode electromagnetically connected to the first and the second patch antenna electrodes.

24. A multiple-resonant antenna comprising:

a dielectric block;

a first patch antenna electrode formed on one main surface of the dielectric block, for receiving and transmitting a radio wave of a first frequency band;

a second patch antenna electrode formed on the main surface of the dielectric block apart from the first patch antenna in a manner of embracing the first patch antenna electrode, for receiving and transmitting a radio wave of a second frequency band lower than the first frequency band;

a third patch antenna electrode formed on the main surface of the dielectric block apart from the second patch antenna electrode in a manner of embracing the second patch antenna electrode, for receiving and transmitting a radio wave of a third frequency band lower than the second frequency band;

a first feeding line electrode electromagnetically connected to the first patch antenna electrode;

a second feeding line electrode electromagnetically connected to the second patch antenna electrode;

a third feeding line electrode electromagnetically connected to the third patch antenna electrode;

a first feeding terminal electrode connected to the first feeding line electrode;

a second feeding terminal electrode connected to the second feeding line electrode;

a third feeding terminal electrode connected to the third feeding line electrode; and a feeding line electrode electromagnetically connected to the first and the third patch antenna electrodes.

25. A multiple-resonant antenna comprising:

a dielectric block;

a first patch antenna electrode formed on one main surface of the dielectric block, for receiving and transmitting a radio wave of a first frequency band;

a second patch antenna electrode formed on the main surface of the dielectric block apart from the first patch antenna in a manner of embracing the first patch antenna electrode, for receiving and transmitting a radio wave of a second frequency band lower than the first frequency band;

a third patch antenna electrode formed on the main surface of the dielectric block apart from the second patch antenna electrode in a manner of embracing the second patch antenna electrode, for receiving and transmitting a radio wave of a third frequency band lower than the second frequency band;

a first feeding line electrode electromagnetically connected to the first patch antenna electrode;

a second feeding line electrode electromagnetically connected to the second patch antenna electrode;

a third feeding line electrode electromagnetically connected to the third patch antenna electrode;

a first feeding terminal electrode connected to the first feeding line electrode;

a second feeding terminal electrode connected to the second feeding line electrode;

a third feeding terminal electrode connected to the third feeding line electrode; and a feeding line electrode electromagnetically connected to the first, the second, and the third patch antenna electrodes.

26. A multiple-resonant antenna comprising:

a dielectric block;

a first patch antenna electrode formed on one main surface of the dielectric block, for receiving and transmitting a radio wave of a first frequency band;

a second patch antenna electrode formed on the main surface of the dielectric block apart from the first patch antenna in a manner of embracing the first patch antenna electrode, for receiving and transmitting a radio wave of a second frequency band lower than the first frequency band;

a third patch antenna electrode formed on the main surface of the dielectric block apart from the second patch antenna electrode in a manner of embracing the second patch antenna electrode, for receiving and transmitting a radio wave of a third frequency band lower than the second frequency band;

a first feeding line electrode electromagnetically connected to the first patch antenna electrode;

a second feeding line electrode electromagnetically connected to the second patch antenna electrode;

a third feeding line electrode electromagnetically connected to the third patch antenna electrode;

a first feeding terminal electrode connected to the first feeding line electrode;

a second feeding terminal electrode connected to the second feeding line electrode; and a third feeding terminal electrode connected to the third feeding line electrode, wherein the third feeding terminal electrode serves as a fixing terminal at a surface mounting time.

27. A multiple-resonant antenna comprising:

a dielectric block;

a first patch antenna electrode formed on one main surface of the dielectric block, for receiving and transmitting a radio wave of a first frequency band;

a second patch antenna electrode formed on the main surface of the dielectric block apart from the first patch antenna in a manner of embracing the first patch antenna electrode, for receiving and transmitting a radio wave of a second frequency band lower than the first frequency band;

a third patch antenna electrode formed on the main surface of the dielectric block apart from the second patch antenna electrode in a manner of embracing the second patch antenna electrode, for receiving and transmitting a radio wave of a third frequency band lower than the second frequency band;

a fourth patch antenna electrode formed on the main surface of the dielectric block apart from the third patch antenna electrode in a manner of embracing the third patch antenna electrode, for receiving and transmitting a radio wave of a fourth frequency band lower than the third frequency band;

a first feeding line electrode electromagnetically connected to the first patch antenna electrode;

a second feeding line electrode electromagnetically connected to the second patch antenna electrode;

a third feeding line electrode electromagnetically connected to the third patch antenna electrode;

a fourth feeding line electrode electromagnetically connected to the fourth patch antenna electrode;

a first feeding terminal electrode formed on a lateral side of the dielectric block and connected to the first feeding line electrode;

a second feeding terminal electrode formed on a lateral side different from the side of the first feeding terminal electrode and connected to the second feeding line electrode;

a third feeding terminal electrode formed on a lateral side different from the sides of the first and the second feeding terminal electrodes and connected to the third feeding line electrode; and a fourth feeding terminal electrode formed on a lateral side different from the sides of the first, the second, and the third feeding terminal electrodes and connected to the fourth feeding line electrode.

28. The multiple-resonant antenna, according to claim 27, wherein the fourth feeding terminal electrode serves as a fixing terminal at a surface mounting time.

29. The multiple-resonant antenna, according to claim 27, wherein the dielectric block has a square horizontal cross section.

30. A multiple-resonant antenna comprising:

a dielectric block;

a first patch antenna electrode formed on one main surface of the dielectric block, for receiving and transmitting a radio wave of a first frequency band;

a second patch antenna electrode formed on the main surface of the dielectric block apart from the first patch antenna electrode in a manner of embracing the first patch antenna electrode, for receiving and transmitting a radio wave of a second frequency band lower than the first frequency band;

a first feeding pin connected to the first patch antenna electrode in a manner of piercing the dielectric block in a thickness direction;

a second feeding line electrode electromagnetically connected to the second patch antenna electrode and formed on a top surface or an inner layer of the dielectric block; and a second feeding terminal electrode formed on a lateral side of the dielectric block and connected to the second feeding line electrode.

31. The multiple-resonant antenna, according to claim 30, wherein the dielectric block is formed by a multi-layer substrate and the feeding pin electrode is formed by a through hole piercing the multi-layer substrate in a thickness direction.

32. The multiple-resonant antenna, according to claim 30, wherein the second feeding terminal electrode serves as a fixing terminal at a surface mounting time.

33. The multiple-resonant antenna, according to claim 30, wherein the dielectric block has a square horizontal cross section.

* * * * *

UNITED STATES PATENT AND TRADEMARK OFFICE

CERTIFICATE OF CORRECTION

PATENT NO. : 6,876,328 B2
DATED : April 5, 2005
INVENTOR(S) : Adachi et al.

It is certified that error appears in the above-identified patent and that said Letters Patent is hereby corrected as shown below:

Column 13,
Line 13, “around” should read -- ground --.
Line 50, “or” should read -- of --.

Signed and Sealed this

Twenty-fifth Day of October, 2005

JON W. DUDAS
*Director of the United States Patent and Trademark Office*